US006302036B1

(12) United States Patent
Carson et al.

(10) Patent No.: US 6,302,036 B1
(45) **Date of Patent: *Oct. 16, 2001**

(54) SHELVING SYSTEM, SHELF SUPPORT, AND SHELF

(75) Inventors: Tim Carson, Thousand Oaks; V. John Ondrasik, Granada Hills; Jeffery Nicholson, Palmdale; Raymundo Calderon, Sylmar; Bennie Reed Downing, Thousand Oaks, all of CA (US)

(73) Assignee: Anthony, Inc., San Fernando, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/102,995

(22) Filed: Jun. 22, 1998

(51) Int. Cl.[7] ..... A47B 9/00

(52) U.S. Cl. ..... 108/110; 108/107; 108/147.17; 211/175; 211/187

(58) Field of Search ..... 108/106, 107, 108/110, 144.11, 144.16, 144.17, 153.1; 211/175; 11/187

(56) References Cited

U.S. PATENT DOCUMENTS

| | | | | |
|---|---|---|---|---|
| 2,897,978 | | 8/1959 | Beckner . | |
| 2,933,195 | | 4/1960 | Radek . | |
| 3,007,708 | | 11/1961 | Ochs . | |
| 3,183,862 | | 5/1965 | Melvin . | |
| 3,194,528 | | 7/1965 | Chesley . | |
| 3,225,719 | | 12/1965 | Marschak . | |
| 3,338,423 | * | 8/1967 | Wellman, Jr. | 211/187 X |
| 3,343,506 | | 9/1967 | Buchbinder et al. . | |
| 3,388,808 | | 6/1968 | Radek . | |
| 3,730,108 | | 5/1973 | Stroh . | |
| 3,844,416 | * | 10/1974 | Potter | 108/107 X |
| 3,993,002 | | 11/1976 | Stroh . | |
| 4,079,678 | * | 3/1978 | Champagne | 108/110 |
| 4,190,167 | | 2/1980 | Wells et al. . | |
| 4,239,100 | | 12/1980 | Corey . | |
| 4,348,001 | | 9/1982 | Baldwin . | |
| 4,955,490 | * | 9/1990 | Schafer | 211/187 |
| 5,127,340 | * | 7/1992 | Maro et al. | 108/107 |
| 5,221,014 | * | 6/1993 | Welch et al. | 211/187 |
| 5,279,430 | * | 1/1994 | Benton | 211/151 |
| 5,360,122 | | 11/1994 | Benton . | |
| 5,474,412 | * | 12/1995 | Pfeiffer et al. | 211/187 X |
| 5,641,083 | | 6/1997 | Metcalf . | |
| 5,806,417 | * | 9/1998 | Whiten et al. | 108/106 |
| 5,845,794 | | 12/1998 | Highsmith . | |
| 5,921,412 | * | 7/1999 | Merl | 211/187 X |

FOREIGN PATENT DOCUMENTS

| | | | | |
|---|---|---|---|---|
| 1085777 | * | 9/1980 | (CA) | 108/106 |
| 992227 | * | 5/1965 | (GB) | 211/187 |
| 205195 | * | 6/1966 | (SE) | 211/187 |

* cited by examiner

*Primary Examiner*—Peter M. Cuomo
*Assistant Examiner*—Hanh V. Tran
(74) *Attorney, Agent, or Firm*—Henricks, Slavin & Holmes

(57) ABSTRACT

A shelving system, shelf support and shelf are provided that are adjustable vertically, horizontally and angularly for better product presentation and maintenance. Brackets are provided which allow depth or horizontal adjustment and another bracket is provided which gives shelf support and allows easier horizontal adjustment. The brackets also permit easier and more reliable vertical and shelf angle adjustments for better product presentation. Shelf assemblies are provided which include adjustable product stops and dividers. Other shelf and product presentation features are also provided.

41 Claims, 29 Drawing Sheets

FIG. 37
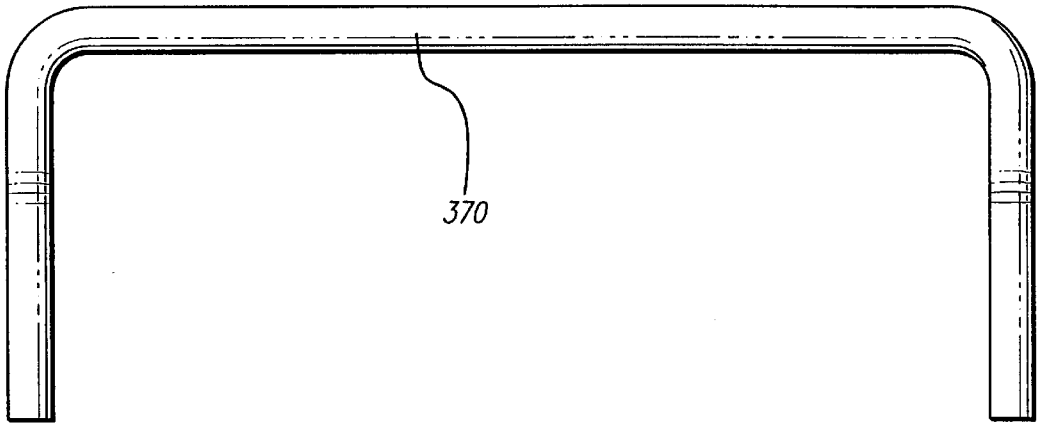
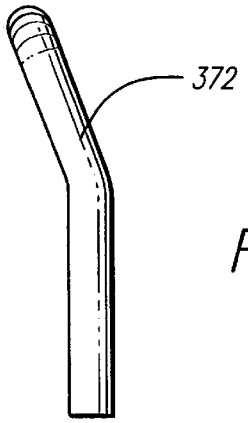
FIG. 38
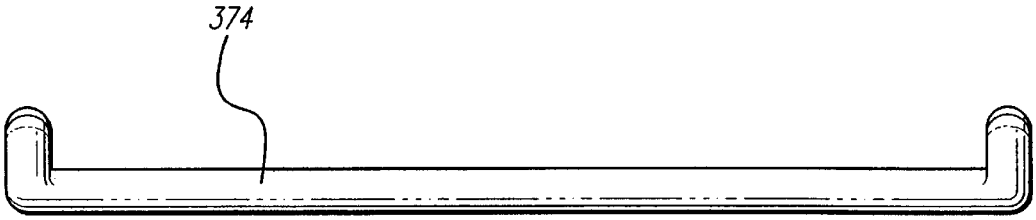
FIG. 39

SHELVING SYSTEM, SHELF SUPPORT, AND SHELF

BACKGROUND OF THE INVENTION

1. Field Of The Invention

This invention relates to display systems and shelf systems, for example systems used for displaying product in refrigerated display cases.

2. Related Art

Conventional shelving systems, for example those used in refrigerated display cases, have a number of configurations, including fixed or adjustable wire shelves, gravity feed shelving systems, and the like. Many of these shelving systems are relatively difficult to use and are costly to make. For example, wire shelving systems may have one type of shelf support structure to accommodate the wire shelves, while a gravity feed shelving system may have a different type of shelf support assembly.

In refrigerated display cases, wire shelves are common and may be stainless steel or plastic or rubber-coated wire. Wire shelves are strong, sturdy and easy to clean. They also permit ventilation of cold or refrigerated air so that all locations in the display case are preferably at the same temperature.

A gravity feed shelving configuration positions one or more shelves on an incline downwardly from the rear to the front of the display case. Inclined or slanted shelving reduces the need for stocking personnel to regularly inspect the shelves and advance product to the front of the shelves. Slanted shelves, at predetermined angles, allow gravity to move product to the front of the shelf These slanted, gravity-fed shelving arrangements are convenient, but are sometimes difficult to properly position for different product to achieve the appropriate product movement. For example, for beverage containers which are relatively heavy compared to similarly sized packages of dry goods, a lesser incline may be used to adequately advance product on a slanted shelf However, too much of an incline may apply too much pressure from rearwardly stocked product on the forward-most product, making that product more difficult to remove, and also possibly unintentionally removing or ejecting following product.

Additionally, different shelving systems may or may not be adjustable, and the mode of adjustability in one shelving system may not be related to the mode of adjustability in another. For example, some wire shelving systems are adjustable upwardly or downwardly, but are not adjustable in depth. Also, some wire shelving systems have little or no adjustability in shelf angle to permit variability in gravity feed. Moreover, some gravity feed shelving systems often require labor-intensive or complicated procedures to adjust or define the amount of gravity feed in the shelving system.

Some shelving systems include shelf divider arrangements to improve product alignment on the shelf and to insure proper advancement of product toward the front of the shelf either manually or through gravity feed. These divider arrangements may differ from one shelf system to another, and may not serve the intended function uniformly for different shelf systems. Additionally, some divider systems are not as stable as others because their mounting or support structures are inadequate, or other limitations prevent optimal functioning of the divider arrangement.

SUMMARY OF THE INVENTIONS

A shelving system, shelf support and shelf are disclosed which include embodiments where the shelves are adjustable front to back, adjustable in angle for gravity feed, that may include dividers or product stops to improve product presentation and stocking procedures, or which are generally easier to use. Some of the embodiments include an improved mounting bracket or shelf mounting arrangement making it easier to adjust shelves, or easier to position shelves at the desired levels on shelf posts or other shelf supports.

In one preferred embodiment, a shelving system includes a shelf support structure and a shelf having a shelf support element wherein the shelf support element engages at least one of several support surfaces on the shelf support structure. For example, the shelf support structure may be shelf posts having a shelf mounting bracket with a number of slots or other shelf support surfaces for the shelf support element. In one embodiment, the shelf mounting bracket includes a number of angled slots spaced apart from each other in a direction which is preferably horizontal to allow the shelf to be positioned and supported by any one of the slots, thereby allowing adjustments in depth for the shelf. The bracket can also take a number of other configurations, for example the slots may be arranged, with respect each other, other than along a horizontal line. Additionally, the slots can be inverted T-shaped or other shapes suitable for positioning, adjusting and supporting shelves.

In one aspect of the inventions, the shelf mounting bracket is supported by first and second shelf posts, wherein the shelf posts include vertically oriented openings or holes to permit vertical adjustment of the bracket. The holes may permit not only vertical adjustability of the shelf, but also adjustment in the angle of the shelf to permit gravity feed at a number of desired angles. Preferably, the bracket engages a number of holes in each shelf post to enhance stability of the assembly. Moreover, each shelf post preferably includes two sets of vertically arranged holes to permit shelves to be placed side-by-side and still be vertically adjustable. The bracket also preferably includes a lock, latch or other retaining element for keeping the bracket in place on the shelf posts until the bracket is to be manually repositioned or removed.

In another aspect of the inventions, a shelf support system may include a base for positioning and supporting a shelf and a shelf support element having first and second portions. The first portion engages the base and the second portion engages a shelf wherein the second portion includes a curved receiving element, such as for receiving and supporting a rail portion of a wire shelf In one embodiment, the base includes one or more shelf posts having openings for receiving a first portion of the shelf support element and wherein the second portion of the shelf support element is a substantially closed loop for supporting a rail or other wire portion on a shelf. Using a loop to support a portion of the shelf permits easy adjustment of the shelf as well as more flexibility in positioning the shelf. This shelf support element also preferably includes a lock, latch or other retaining element for holding the shelf support element in place until manually repositioned or removed.

In another aspect of the inventions, a shelf is provided for supporting and displaying products. It includes a substantially planar shelf portion and a longitudinally extending element extending across the front, rear or other portion of the shelf and having a number of engagement surfaces for engaging the product support. The longitudinally extending element may be an aperture bar extending across the front of the shelf, and the product support may be a divider or other bar or wire for positioning product or making it easier to move product on the shelf. The aperture bar may be adjustably fixed to the shelf so that the bar may be raised, lowered or otherwise repositioned as desired. The aperture bar preferably accepts and holds in position one or more dividers having hooks, prongs or other mounting elements for engaging the aperture bar. The aperture bar can also serve as a product stop at the front of the shelf. An aperture bar can also be placed at the rear of the shelf for holding one or more dividers and also for minimizing the possibility of product being pushed off the rear of the shelf Preferably, the rear aperture bar is spaced from the surface of the shelf to permit insertion of a glide or slide sheet under the rear aperture bar and across the top of the shelf. The glide sheet may be used to ease movement of product in a gravity feed arrangement.

In another aspect of the inventions, a wire shelf may include a divider having a front portion for engaging a front of the wire shelf and a rear portion for engaging a rear portion of the wire shelf. Preferably, the divider has a front portion which includes first and second wire engagement portions. The divider helps to position product and makes it easier to move product on the shelf. The first and second wire engagement portions help to stabilize the divider and hold it in place. Preferably, the wires on the wire shelf are spaced a first distance apart and the first and second engagement portions are spaced a second distance apart different from the first distance. Where the second distance is sufficiently greater than the first, the first and second wire engagement portions span or straddle two wires on the wire shelf, thereby further stabilizing the divider on the shelf. The divider may also include a cross piece which bears against one or more of the wires on the shelf to also help stabilize and hold the divider in place. In one preferred embodiment, the divider also includes a front and/or rear product stop as part of the divider. In an alternative embodiment, the second distance is less than the first distance but a support bar helps to keep the divider in position. The support bar may take the form of the aperture bar for holding the dividers in place.

These and other aspects of the present inventions will be more fully understood after a consideration of the brief description of the drawings and the detailed description of the preferred embodiments.

BRIEF DESCRIPTION OF THE DRAWINGS

FIG. 37 is a front elevation view of a front product stop alternative to that of FIG. 26 that can be used on an existing shelf.

FIG. 38 is a front elevation view of an additional front product stop alternative to that of FIG. 26 that can be used on an existing shelf.

FIG. 39 top plan view of a third front product stop alternative to that of FIG. 26 that can be used on an existing shelf.

DETAILED DESCRIPTION OF THE PREFERRED EMBODIMENTS

Figure 1:
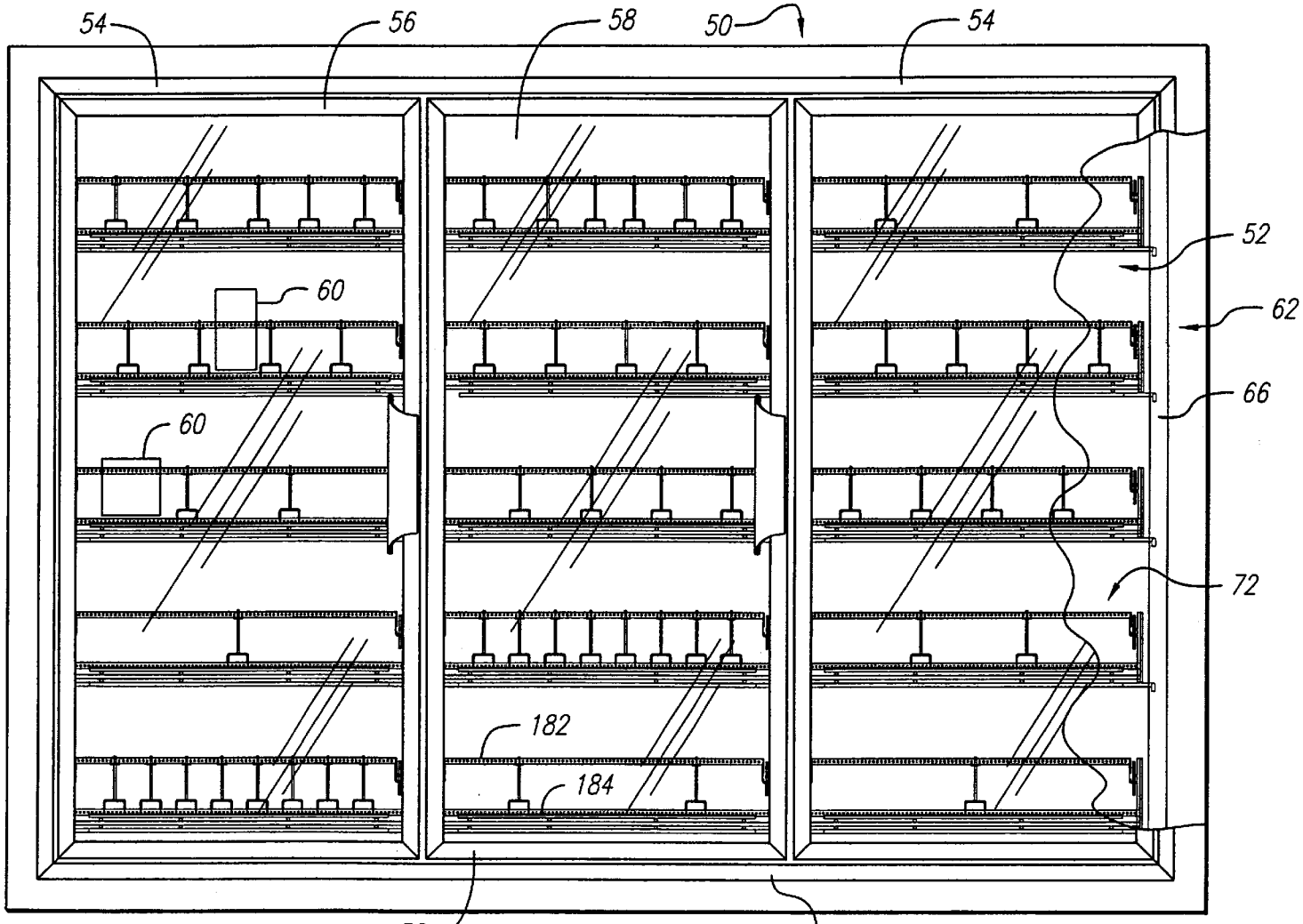
FIG. 1 is a front elevation view and partial cutaway of a product display case showing shelves and dividers in accordance with one aspect of the present inventions.

A shelving system, shelf support and shelf are described which allow vertical, horizontal and angled shelf adjustment, and which is easier to use relative to conventional shelving systems. The shelf supports and shelves can accommodate close shelf positioning. The shelving system may also include dividers which can be positioned at a number of locations on a shelf. In some embodiments, the dividers can be adjustable in height, and the dividers can be positioned at a variety of locations across the shelf. These and other aspects of the present inventions are described more fully below.

Product displays find application in many areas of consumer wholesale and retail marketing. Food products and other consumables are often displayed to consumers and other purchasers on shelf displays that may take any number of different configurations. For example, the shelf displays may be portable or fixed to a store floor or wall section. The shelf display may be a single shelf or multiple shelves, different types and sizes, adjustable or fixed, flat or sloped or slanted, or any number of other configurations. For the present discussion, the description of the shelving system, shelf support and shelf configurations will be given in the context of refrigerated display cases, such as those found in grocery stores, convenience stores and the like. However, it should be understood that the invention is not limited to refrigerated display cases, food or other consumable products, but can be extended and is applicable to other display applications and shelving systems.

In the context of refrigerated display cases 50 (FIG. 1), a shelving system 52 may be placed inside a cabinet having a frame 54 surrounding and supporting a number of doors 56. The doors 56 typically include glass panels 58 to permit viewing a product 60 inside the display case and to permit access to the product 60. The cases 50 are often designed so as to maximize the product capacity of the case, maximize the viewing area for the customer, and to maximize the shelf space available for displaying and stocking product. Consequently, the shelving system 52 preferably accommodates a large amount of product per shelf, different types and sizes of product, such as boxes, plastic and glass containers, beverage cans, and round and rectangular containers, and with different presentations. The shelving system 52 also preferably permits gravity feed of product, common in grocery stores and convenience stores.

Figure 2:
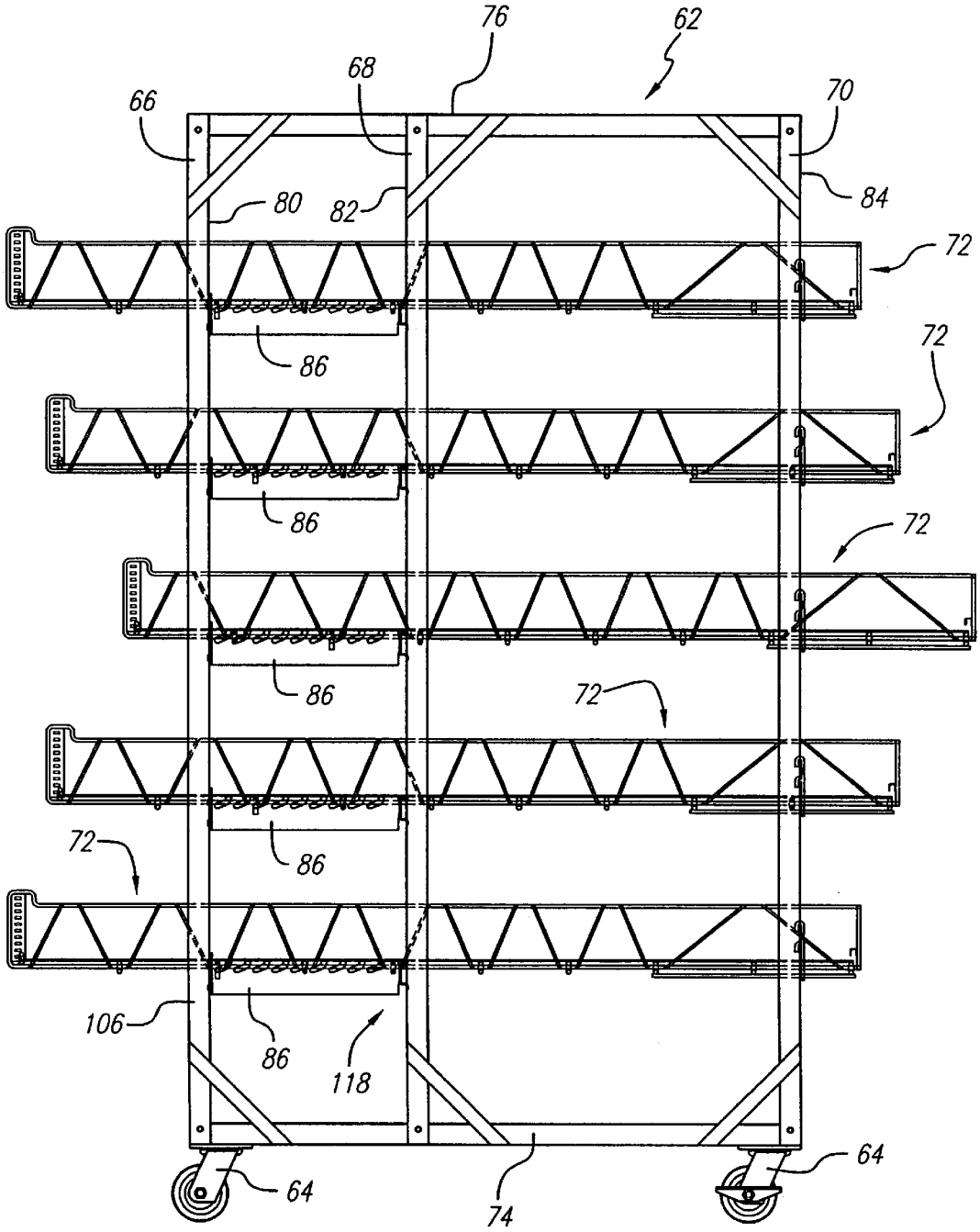
FIG. 2 is a side elevation view of a shelving system, such as that which may be used in the display case of FIG. 1, showing a shelf support, shelves and several other features in accordance with several aspects of the present inventions.

In one embodiment of a shelving system 52 (FIGS. 1 and 2), the shelving system includes a frame structure 62 which may rest freely on the floor, be fixed to the floor through bolts, or to the surrounding frame through brackets or straps, or supported by casters 64. The present invention is not limited to a particular type of frame structure or its mobility. In one preferred embodiment, the frame structure 62 includes a front shelf post 66, an intermediate shelf post 68 and a rear shelf post 70 for supporting one or more shelf assemblies 72. While a given shelf assembly will typically include corresponding or paired left and right shelf posts, only the right shelf posts are shown in FIGS. 1 and 2. Additionally, shelf posts are not required to practice the invention, and other shelf supports such as wall units, panels or other structures which can support and engage mounting brackets for supporting shelf assemblies can also be used. However, because shelf posts are common in the grocery and other food product industry, the description of the shelving system will be made in the context of discrete shelf posts assembled into a frame structure 62 such as that shown in FIG. 2. The shelf posts may extend vertically, horizontally or at an angle, as desired. The shelf posts may be conventional shelf posts known to those skilled in the art, and which may support adjacent shelf, permit shelf height adjustment through openings and permit positioning of the shelf in an incline configuration for gravity feed of product.

Figure 12:
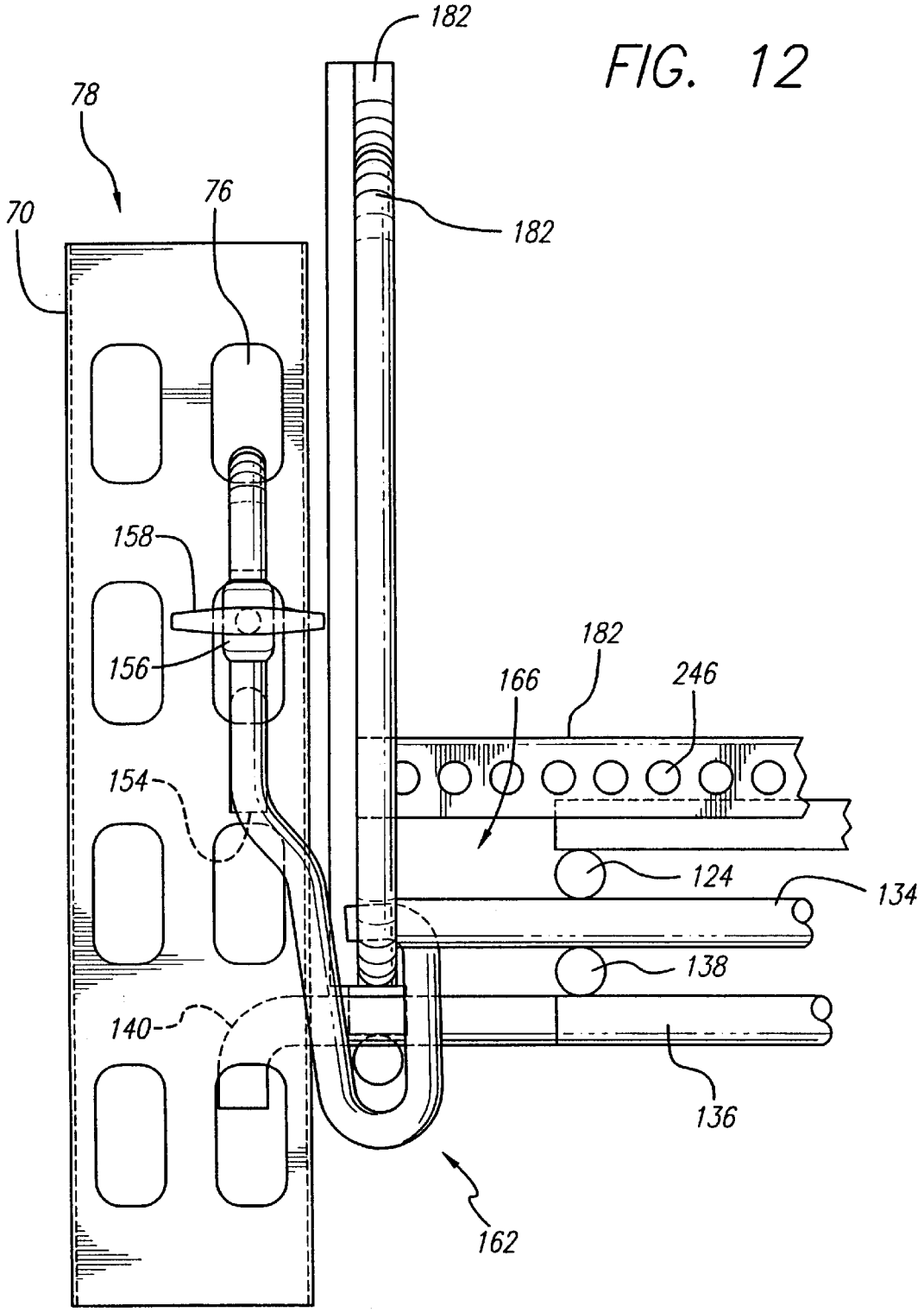
FIG. 12 is a rear vertical section taken of the shelving assembly of FIG. showing the shelf post and S-hook.

The frame structure 62 may include rearwardly and horizontally extending bottom frame bars 74, and top frame bars 75 for stabilizing the shelf posts 66, 68 and 70. Each shelf post preferably includes a number of vertically spaced apart openings 76 (FIG. 12) for engaging and supporting brackets or other hardware, described in more detail below, for positioning and supporting shelf assemblies. The openings are preferably rectangular, as shown in FIG. 12, and are spaced from each other by an amount appropriate for the application. Each shelf post also preferably includes a second column of vertically spaced-apart openings 78 for engaging and supporting a bracket or other hardware for an adjacent shelf assembly. The openings 76 and 78 are formed in the surface of the respective shelf post to be accessed by the particular hardware supported by the respective shelf post. For the front shelf posts 66, the openings are preferably formed in the rearward facing surface 80 of the shelf post. The openings can be formed in other sides of the shelf post as desired, such as for stability, ease of access, and the like. Because many conventional shelf posts have four sides forming a rectangle or square cross-section, the shelf posts described herein will be described as having four flat sides forming a rectangular cross-section.

The middle shelf post 68 also includes first and second series of vertically spaced apart openings for accepting and supporting hardware for supporting a shelf assembly. In the preferred embodiment, the openings are formed in the forward facing surface 82 of the middle shelf post 68. The rear shelf post 70 also includes a like arrangement of openings for accepting and supporting hardware for supporting a shelf assembly. Preferably, the openings in the rear shelf posts 70 are formed in the rearward facing surface 84 of the shelf post. The openings in each of the shelf posts are formed so as to be distributed along as much of the respective surfaces of the shelf posts as desired. Typically, the openings are distributed along the entire vertical length of the shelf post.

One or more pairs of the shelf posts may be connected at their tops or elsewhere by stabilizer bars (not shown). The bars will help to support the frame and the shelf assemblies, especially against side forces. Other additional support structures can be included beyond those elements described herein or shown in the Figures.

Figure 3:
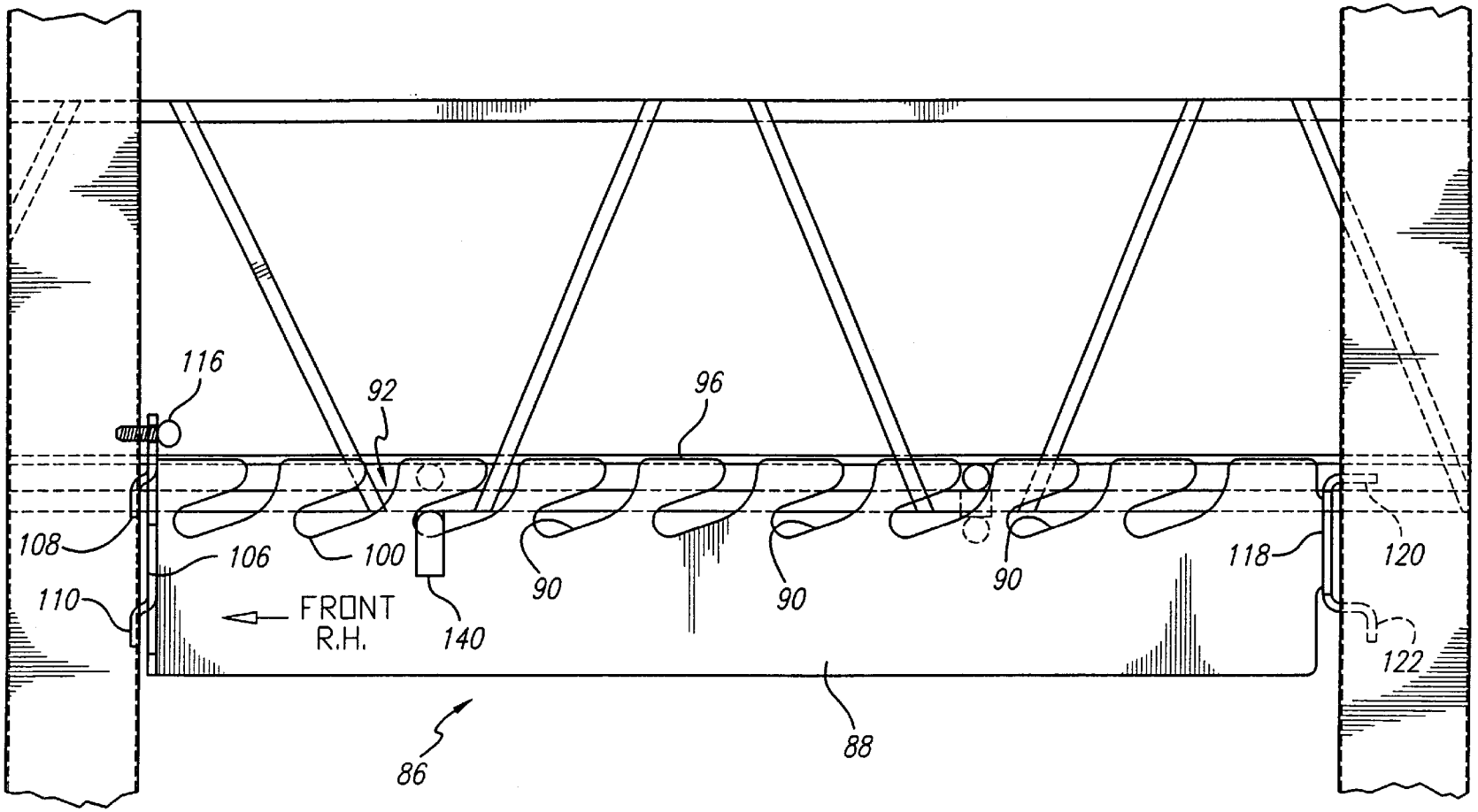
FIG. 3 is a left side elevation view of a portion of the shelving system of FIG. 2.

While conventional shelf posts and similar support structures can accommodate the new shelf assemblies made according to one or more aspects of the present inventions, one or more of the shelf posts may also include one or more shelf assembly supports in the form of brackets 86 for supporting and positioning the shelf assemblies 72. (See, FIGS. 2–4.) Where the bracket 86 is mounted only to the forward shelf post 66, the intermediate shelf post 68 can be omitted. However, the bracket 86 is preferably supported by two shelf posts, the forward shelf posts 66 and the middle shelf posts 68 to provide sufficient strength, stability and integrity. The shelf assembly preferably includes two brackets for each shelf assembly, one bracket on each side of the shelf assembly.

Each bracket 86 preferably includes an aperture plate 88 having a plurality of shelf assembly support surfaces 90 for supporting a shelf assembly 72 through pins, rods, projections or other suitable engagement surfaces on the shelf, described more fully below. In a preferred embodiment, the shelf assembly support surfaces 90 are formed as angled slots 92 spaced apart from each other along a horizontal line 94 to adequately separate the slots from one another and to provide sufficient strength and integrity to each slot 92 and the aperture plate 88. The slots 92 are formed in an upper surface 96 of the aperture plate to make easier insertion of the supporting bar of a shelf assembly into a selected slot.

The slot 92 is preferably formed as an angled slot having a first substantially vertical section 98 and a second substantially slanted portion or section 100. The vertical section 98 facilitates insertion of the supporting bar of the shelf assembly into the slot 92. The slanted section 100 makes easier the proper seating of the shelf assembly supporting bar at the bottom of the slot for stability and proper positioning of the shelf assembly relative to the supporting frame. The slant allows the weight of the shelf assembly and gravity to properly seat the shelf assembly supporting bar at the bottom of the slot.

The forward entrance surface 102 and the rearward entrance surface 104 of each slot are preferably rounded or smooth so as to help the positioning and insertion of the shelf assembly supporting bar into the desired slot. In the preferred embodiment, the right and left brackets are mirror images of each other so that adjustment of a shelf assembly relative to the respective brackets can be made at the same time and with the same movement of the shelf assembly. Alternatively, the vertical or horizontal positioning of the slots on one bracket may be different from that for the other bracket so that any given movement of a shelf assembly would not be likely to fully disengage the shelf assembly from both brackets. For example, if corresponding slots on left and right brackets were horizontally displaced relative to the forward most surface of each bracket, removal of the shelf assembly might require first the lifting of one side of the shelf assembly to remove that side from the respective bracket, followed by lifting of the opposite side of the shelf assembly to remove it from its respective bracket. Using a step wise removal process may provide a measure of security to ensure that complete disengagement of a shelf assembly from respective brackets occurs only with a particular sequence of shelf movements.

Figure 5:
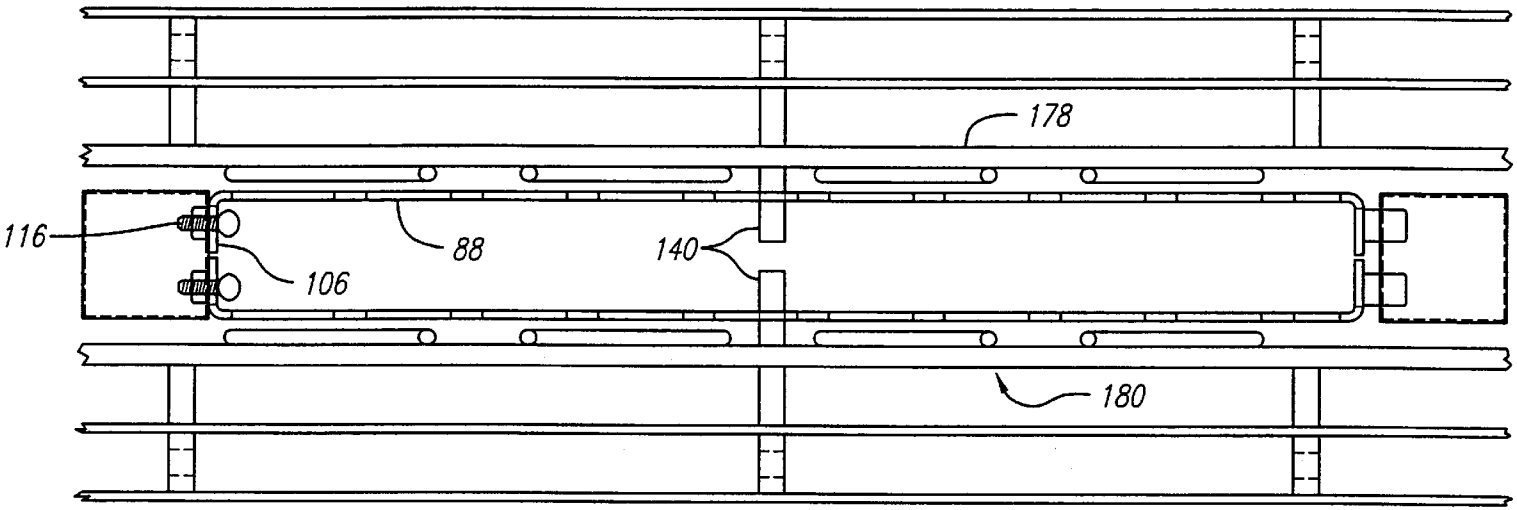
FIG. 5 is a partial top plan view of a shelving system in accordance with one aspect of the present inventions showing shelf posts and adjacent shelf mounting brackets supporting respective shelves.

Each bracket also preferably includes a front mounting plate 106 for engaging the front shelf post 66 so that each bracket can be properly supported and positioned relative to the shelf post, to properly support and position the corresponding shelf assembly 72. The front mounting plate 106 preferably includes an upper S-tab 108 and a lower S-tab 110 for extending through and engaging respective openings in the shelf post 66. The S-tabs 108 and 110 extend a distance sufficiently away from the surface 112 of the front mounting plate 106 to adequately engage the wall of the shelf post without excessive movement of the bracket relative to the shelf post. Two S-tabs are preferred in order to insure adequate stability and positioning of the bracket relative to the shelf posts. The S-tab lengths are preferably sufficient to minimize the possibility of the bracket working free of the respective openings. As shown in FIG. 5, the front mounting plate 106 is preferably formed as a flange extending perpendicular to the aperture plate 88. The front mounting plate 106 also preferably includes a locking portion 114 for accepting a thumb screw 116 or for accommodating another form or type of locking, latching or securing element that might be used. The locking portion may be positioned at any point on the bracket that would permit securing the bracket relative to a shelf post or other reference point.

Each bracket also preferably includes a rear mounting plate 118 formed as a flange relative to the aperture plate 88. The rear mounting plate 118 includes a right angled tab 120 and an extended S-tab 122 for engaging respective openings in the middle shelf post 68. The tabs 120 and 122 permit insertion of the tabs in respective openings in the middle shelf post 68 first before inserting the tabs 108 and 110 in the front shelf post 66. The lengths of the tabs 120 and 122 are preferably sufficient to permit horizontal movement of the bracket to properly position the tabs 108 and 110 in the front shelf post 66. The tabs 118 and 122 also help to support and properly positioned the bracket 86 in the middle shelf post 68 and relative to the frame assembly 62.

Figure 4A:
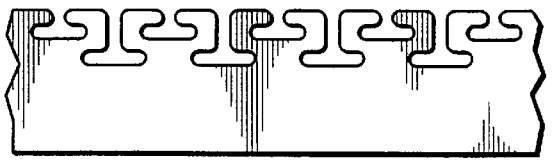
FIG. 4A is a side elevation of a part of an alternative bracket for use with a shelving system.
Figure 4:
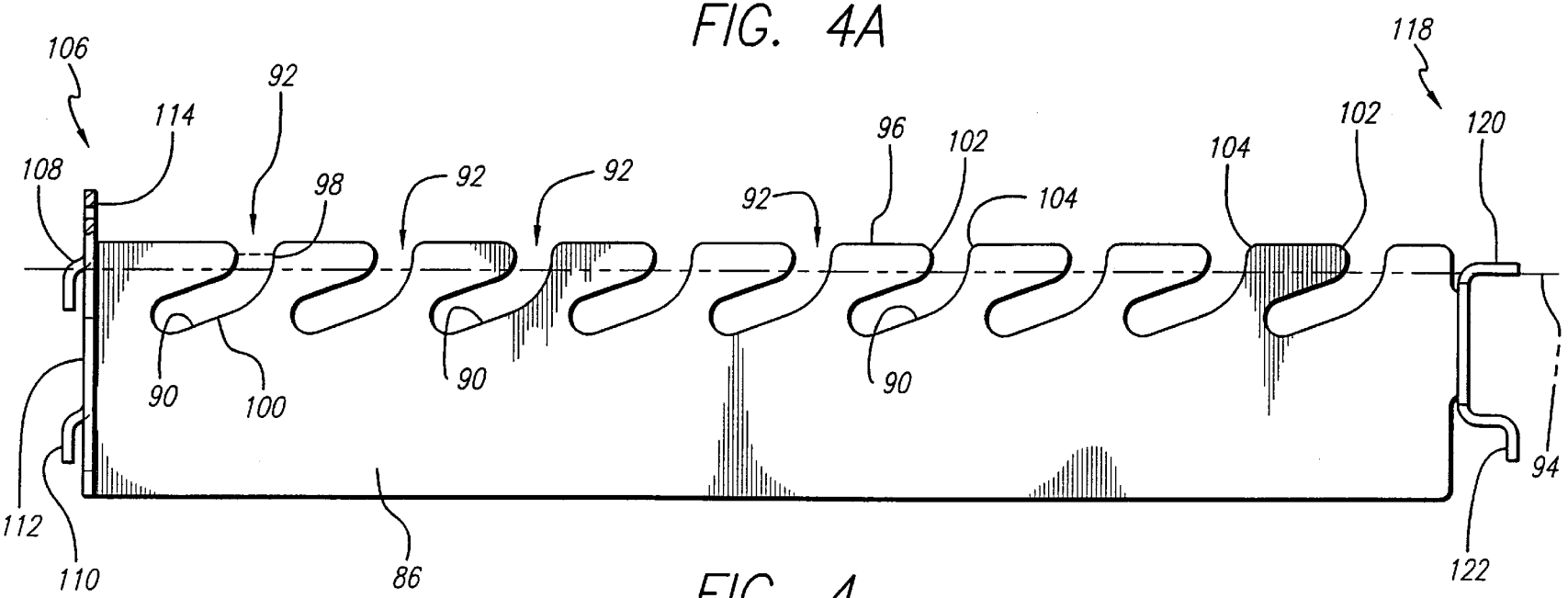
FIG. 4 is a side elevation view of a support or bracket for supporting a shelf assembly in accordance with several aspects of the present inventions.

An alternative bracket is shown in FIG. 4A, where the slots are T-shaped and staggered vertically and horizontally so that more flexibility is given in the height and depth of shelf position. Other slot shapes can be used in the bracket or other shelf support, however, the T-shaped slots provide a relatively positive positioning of the shelf in the bracket. Additionally, the T-shaped slots provide a more concentrated effort to filly remove the shelf from the bracket, thereby providing added safety. The paired T-slotted brackets, one on each side of the shelf, can be offset relative to each other so that movement of the shelf to remove the shelf from a bracket removes only one side for a given movement of the shelf. Therefore, movement of the shelf within the brackets will remove the shelf from one side first and a similar movement will then remove the shelf from the other bracket. The T-shaped slots can be staggered by having the slots on one bracket closer to one shelf post than the slots on the other bracket for the same shelf. The lengths of the horizontal portions of the T-slots may be varied to accommodate the required shelf movement to properly remove the shelf from the brackets.

In refrigerated display cases, conventional shelves are typically wire shelves and are similar to those shown in U.S. Pat. Nos. 5,301,092 and 5,605,237, incorporated herein by reference. The shelves typically include longitudinally extending wire running from front to back of the shelf. Upper and lower perimeter wires sandwiching the forward and rearward ends of the longitudinal wires as well as any laterally extending edge wires on the shelf. The upper perimeter wire typically serves as a rim or top edge which may prevent placement of product on the edge of the shelf in such a way that the product may fall off the shelf. If any product is placed on the upper perimeter wire, the upper perimeter wire may cause the product to be tilted toward the center of the shelf, thereby minimizing the possibility that the product will fall from the shelf.

The shelf assembly 72 may take a number of forms and still adequately function in any number of the ways described herein, for example with the shelf support structure described above. In several of the embodiments, the shelf assembly may simply be a conventional wire shelf with one or more of the additional features described herein, or the shelf assembly may be an assembly formed from a planar, unperforated sheet or other product support. Because many conventional refrigerated display cases use wire shelves, the discussion of the shelf assembly will be made in the context of a wire shelf.

Figure 6:
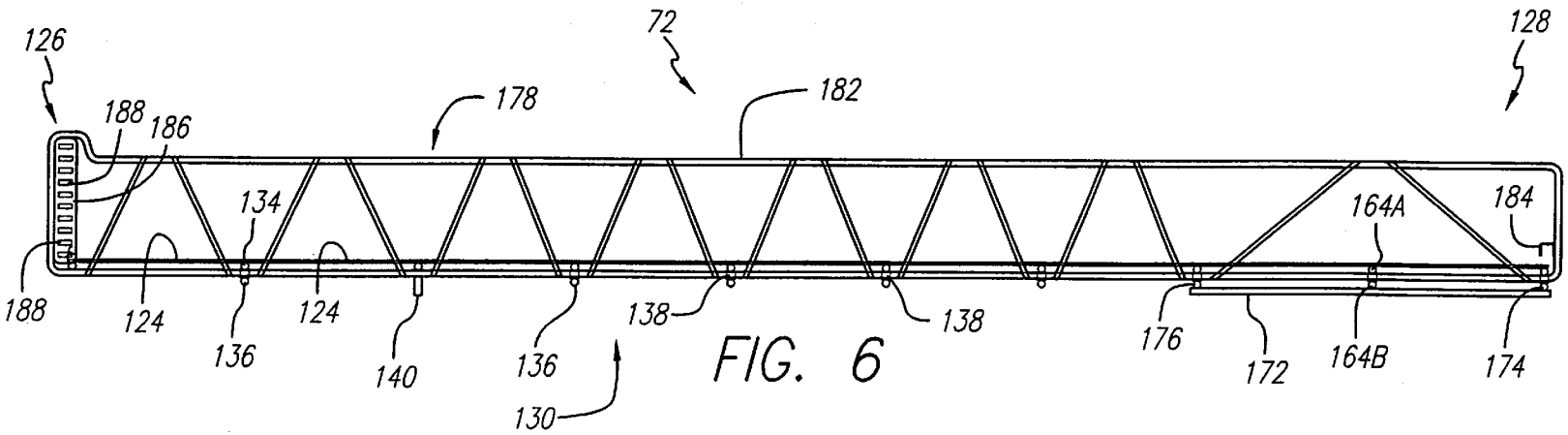
FIG. 6 is a side elevation view of a shelf for supporting product in accordance was several aspects of the present inventions, and which may be used with the shelving systems of FIGS. 1 and 2.

In one preferred embodiment, a shelf assembly 72 (FIGS. 6 and 7) includes a grill or array of wires 124 for supporting product. The wires 124 extend longitudinally from the front of the shelf 126 to the rear 128. The longitudinally extending wires 124 are the wires on which product rest. The wires 124 are formed with a thickness and are spaced apart a distance sufficient to adequately support the product. The wires are typically formed from steel or other suitable metal and coated with a plastic or other suitable impervious material, as is known to those skilled in the art.

The shelf has a first or right side 130 and a second or left side 132. The relative descriptions of left and right, and front and rear, are used in the context of refrigerated display cases. The point of reference is typically from the viewpoint of a customer looking at product from outside the display case. However, these descriptions are used to help understand the apparatus, and are not intended to limit the interpretation of the structure, function or application of the shelf system The dimensions of the shelf are preferably maximized to permit display of or to permit stocking a maximum amount of product. The wires 124 are preferably positioned across substantially the entire width of the wire shelf, and are supported by upper horizontal supporting cross bars 134 in the conventional manner. A second set of lower horizontal supporting cross bars 136 reinforce the upper cross bars 134 and are separated therefrom by short segments of spacer wire 138, as is known to those skilled in the art.

The shelf assembly 72 preferably includes a shelf support element 140 for engaging the shelf and also for engaging at least one of the slots or other shelf assembly support surfaces in the bracket or other shelf support structure. The shelf support 140 is positioned on both the left and right sides of the shelf so that the shelf is supported on both sides thereof and to provide proper support for the shelf assembly. The shelf support element 140 can be positioned almost anywhere on the shelf assembly, such as the front, sides or rear portions of the shelf, but is preferably positioned on each side of the shelf and part way rearward from the front of the shelf. In the preferred embodiment where the shelf is five feet long, the shelf support element 140 is preferably formed integral with the second lower cross bar 136 rearward from the front 126 of the shelf. Conversely, if the bracket or other shelf support structure is located closer to the rear of the frame structure, the shelf support element 140 would be preferably positioned toward the rear of the shelf. The shelf support element 140 is preferably positioned below wires 124 to maximize the support provided by the support element 140.

The support element 140 is preferably formed as a right angle, downwardly extending bar, hook, arm or other engagement member for adequately engaging the slots of the bracket. The support element 140 on each side of the shelf preferably extends downwardly so as to limit any lateral movement of the shelf assembly. The support element 140 preferably extends laterally a sufficient distance to fully engage the respective slot in the bracket so that the shelf is properly supported by the bracket. The amount by which the support elements 140 extend on the right and left sides of the shelf will depend in part on the thickness of the aperture plate of the bracket and on the amount of lateral movement acceptable for the shelf. These dimensions will also affect how easy it is to lift the shelf assembly from the bracket slots and reposition the shelf assembly.

The horizontal portion 142 of the shelf support element and the downwardly extending vertical portion 144 are preferably formed to have the same diameter as the horizontal support cross bars 134. However, the vertical portion 144 of the shelf support element 140 can be formed to have any number of configurations. For example, the end of the horizontal portion can be formed to include a boss or other enlarged portion having a diameter or other dimension preferably at least slightly larger than the spacing or width of the slots in the bracket. The horizontal portion 142 would continue to provide vertical support for the shelf assembly and the enlarged portion would serve the lateral support and positioning function. Alternatively, the vertical portion 144 can be omitted while making the horizontal portions 142 sufficiently long to minimize the possibility that the portions 142 would come out of the respective slot, or the sides of the shelf assembly could provide the lateral positioning.

In addition to shelf support elements on one part of the shelf, such as the front portion and on each side of the shelf, conventional shelf systems include additional support structures at one or more additional locations about the shelf to provide a stable support for the shelf and product on the shelf Typically, the shelf supports are located at or near the four corners of a rectangular shelf In the preferred embodiment, shelf supports additional to the shelf support elements 140 are located at or near the rear of the shelf assembly. Preferably, the shelf support system includes the rear shelf post 70 forming a base or other support for positioning and supporting the shelf and to maintain the shelf in a selected position, such as vertically relative to the shelf post 70. The shelf can be supported relative to the shelf post 70 by a bracket such as bracket 86 cantilevered from the shelf post 70. In such a configuration, the shelf would include a pin, hook or arm similar to support element 140 at the front of the shelf, and adjustment of the shelf can be accomplished by lifting the entire shelf, front and back simultaneously, to a new position. Adjustment of the shelf can be made easier with one person at the front of the shelf and one person at the rear of the shelf.

The bracket 86 permits horizontal adjustment or repositioning of the shelf assembly relative to the case or the frame structure 62. Consequently, the depth of the shelf relative to the frame structure 62 can be easily changed to accommodate different product display configurations. For example, shelves containing larger product can be positioned further back from the front of the shelving assembly, while shelves containing smaller product may be placed forward for easier viewing and selection. Additionally, shelves at eye level may be placed further back from the front of the frame assembly 62 so the product on lower shelves can be seen more easily. Therefore, horizontal adjustment of shelving assemblies permits more flexibility in product presentation.

Additionally, horizontal shelf adjustment may also make it easier to accommodate longer shelves in a shelving assembly.

In an alternative preferred embodiment of a shelf support, a shelf support or S-hook 146 (FIGS. 2 and 9–12) includes a first portion 148 for engaging a shelf post and a second portion 150 for engaging the shelf assembly 72. In the preferred embodiment, the shelf support 146 supports the shelf assembly relative to the shelf post or other base, while permitting the shelf assembly to move horizontally relative to the shelf support 146, as well as a small amount in other directions to permit relatively smooth and easy horizontal adjustment of the shelf assembly. For the first portion 148, the shelf support 146 preferably includes suitable mounting or engagement means to securely and reliably mount the shelf support 146 to the shelf post 70. For example, the first portion 148 may include a first hook 152 for engaging a first opening in the shelf post 70, and a second hook 154 for engaging a second opening in the shelf post 70. One of the hooks can be omitted, but both hooks are preferred in order to insure a secure and stable mounting of the shelf support 146. The lengths of the hooks 152 and 154 are preferably sufficiently long to insure stable engagement with the shelf post 70, while sufficiently short to permit removal of the shelf support 146 from the shelf post 70.

The S-hook 146 also preferably includes a locking plate 156 or other base to threadably receive a locking bolt 158 or other latch, retainer or lock for securing the S-hook in place once properly positioned. The bolt 158 is preferably positioned between the hooks 152 and 154 and engages part of the opening through which hook 154 extends. The locking bolt 158 may be positioned at other locations on the S-hook 146 and engage other portions of the shelf post 70 and still achieve the same function.

The second portion 150 of the S-hook 146 extends outwardly in a direction perpendicular to the plane defined by hooks 152 and 154, and is offset therefrom by an angle portion 160. The second portion 150 also includes a curved receiving element in the form of a loop 162 for receiving and supporting a rail portion of the wire shelf, described more fully below. The loop 162 preferably extends downwardly from the angle portion 160 a distance sufficient to encircle two spaced apart rail portions of the shelf assembly. The loop 162 is preferably substantially closed once it is placed around the rail elements so that the S-hook becomes part of the shelf assembly. (See, FIG. 12.) The width of the opening of the loop 162 is preferably sufficient to permit free movement of the rail elements through the loop, but preferably small enough to minimize any interference with product on an adjacent shelf. In the preferred embodiment, the loop 162 is preferably configured so as to define a plane perpendicular to the shelf rails it encloses. However, the loop 162 can be configured to define a plane at less than a 90 degree angle, or the width of loop 162 can be narrower, so as to produce a drag on movement of the rails through a loop. A drag on movement of the rails minimizes the possibility of the shelf assembly being moved too quickly in the shelf frame, or gaining too much momentum during movement.

The height of the loop 162 is preferably sufficient to permit angling or slanting of the shelf for gravity feed. The height of the loop 162 should be sufficient to accommodate an angle in whatever wires of the wire shelf pass through the loop. Therefore, the height of the loop may be determined in part by the diameter of the wires, and the maximum amount of angle for the shelf In conjunction with the shelf support element 140 and bracket 86, the shelf support element 146 allows horizontal shelf adjustment by a single person. The S-hook 146 allows longitudinal or horizontal movement of the shelf assembly without disengaging the S-hook from the shelf post 70. When the shelf support element 140 and bracket 86 are placed at the front of the shelf assembly, a technician can easily adjust the horizontal position of the shelf assembly in the case, and see where the final position of the shelf will be without having to maneuver around the shelf assembly. If the shelf support elements were transposed, from front to back, adjustment of the shelf would preferably be accomplished from the rear of the shelf Under such circumstances, the intermediate or middle shelf post 68 would be placed closer to the rear shelf post 70 and the brackets 86 would extend between the middle shelf post 68 and rear shelf post 70.

In order to permit a wide range of horizontal movement of a conventional wire shelf, a sufficient length of support wire is built into the shelf to permit free movement of the shelf relative to the S-hook 146. In the preferred embodiment, the No. 2 cross bar 164 (FIG. 4) from the rear 128 of the shelf is shortened so that it does not extend fully to the right and left sides 130 and 132 of the shelf, to provide a right and left pathway 166 and 168, respectively, for the S-hook on each side of the shelf. As a result, the shelf assembly 72 can move a distance substantially equal to the distance from the rear 128 of the shelf to the No. 3 cross bar 170. To provide the structural support lost by foreshortening the upper cross bar 164A and the lower cross bar 164B, one or more reinforcing bars 172 extend from the lower No. 1 cross bar 174 to the lower No. 3 cross bar 176. The reinforcing bars 172 couple the rear 128 of the shelf assembly to the No. 3 reinforcing bar 176 to better support the wires extending between the cross bar 170 and the rear 128.

The shelf support elements 140 and 146 and the shelf posts along with any bracket provide for a number of different modes of adjustment and positioning of the shelf assembly. Positioning of the bracket 86 on the shelf posts and positioning of the S-hooks on the respective shelf posts adjust the angle of the shelf assembly, and therefore the amount of force provided by gravity feed. With the brackets 86 and the corresponding number of shelf support surfaces or slots, the shelf assembly can be positioned horizontally at a number of depth-wise positions in the shelf system. Additionally, the vertical positions of the shelves, and the relative positions between shelves can be easily determined, and any desired adjustments can be made relatively easily. The shelf assembly support elements are relatively stable and reliably support shelf assemblies in a wide variety of configurations. No tools are necessary to reposition the shelves or the other elements of the shelving assembly, and such repositioning is relatively easy to do.

The shelf assemblies 72 also preferably include a right side product stop 178 and left side product stop 180 (FIG. 5) for limiting the sideways movement of product on the shelf and helping to guide product from the rear of the shelf toward the front. The side product stops 178 and 180 also provide structural support for the shelf, and are preferably formed from a continuous wire 182 (FIG. 6), which also extends between the upper and lower cross bars 134 and 136.

Figure 18:
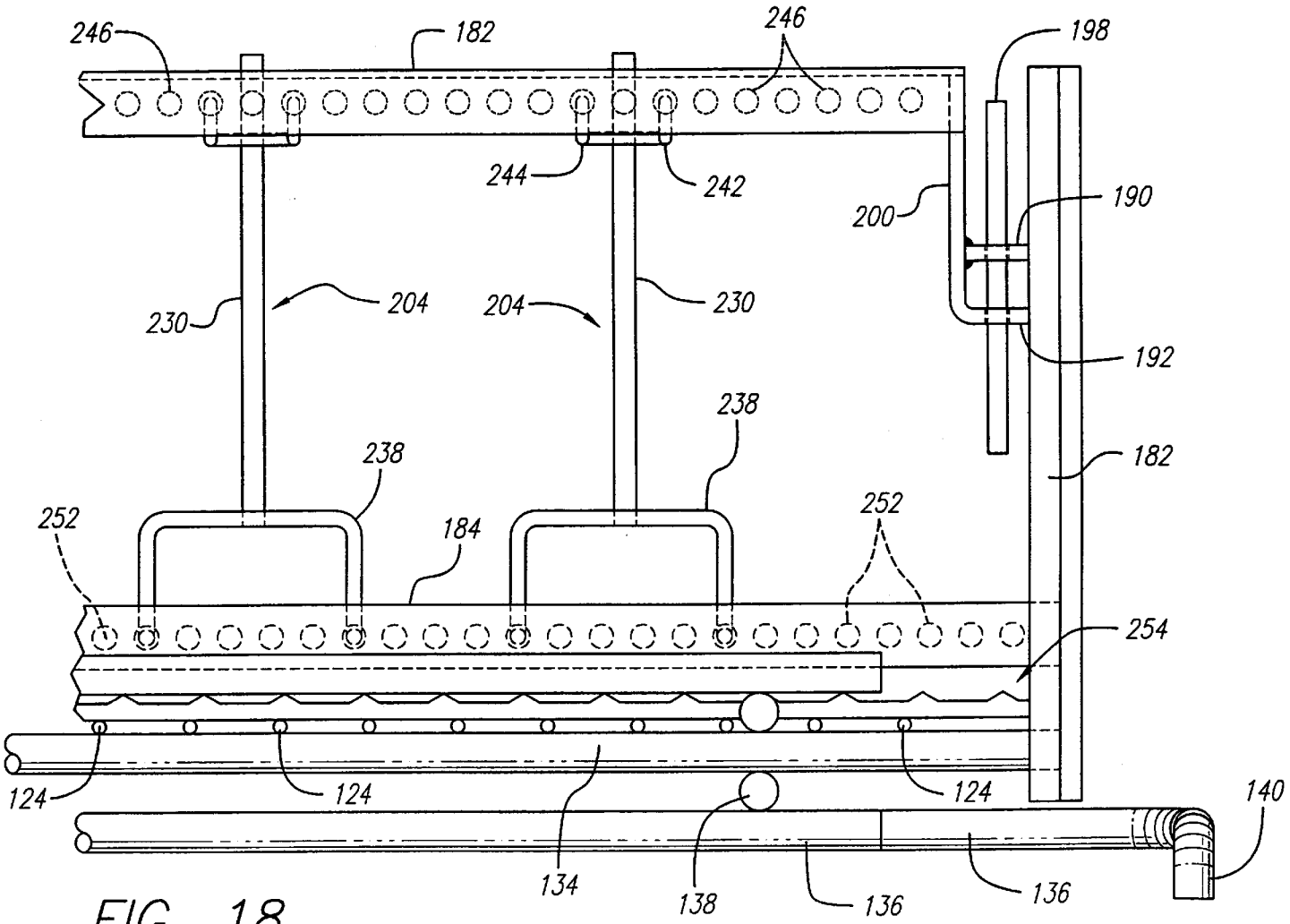
FIG. 18 is a partial front elevation view of a shelf assembly similar to that of FIG. 6 showing product stop bars and dividers.
Figure 19:
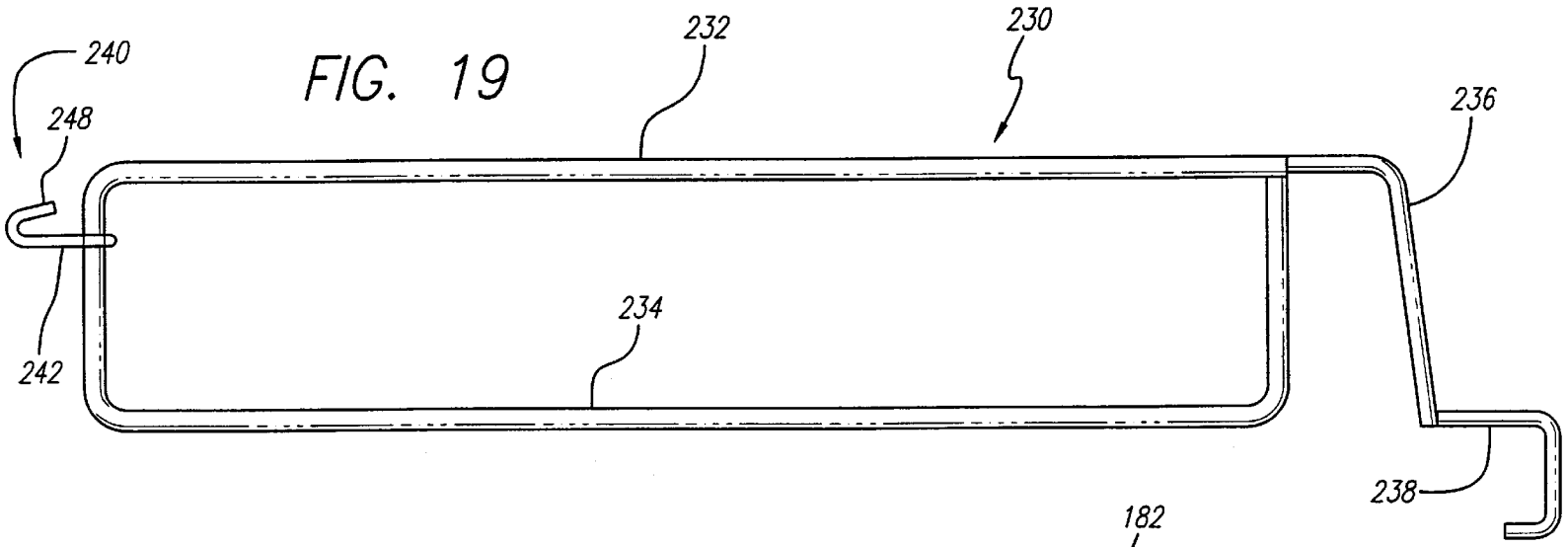
FIG. 19 is a side elevation view of a divider for use in one aspect of the present inventions.
Figure 22:
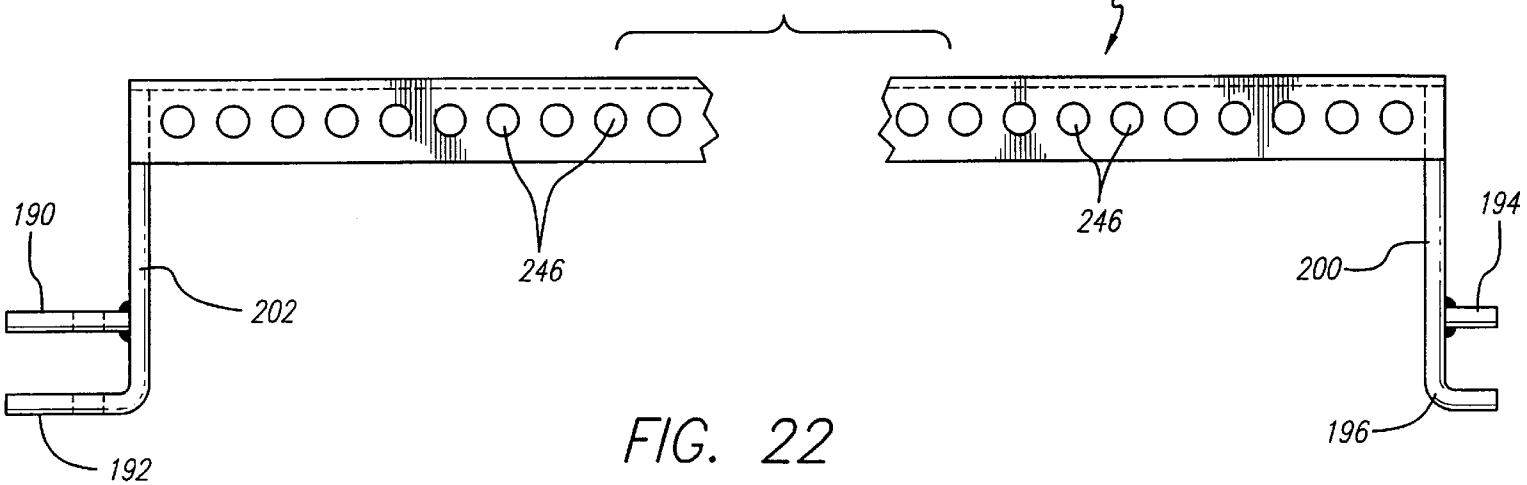
FIG. 22 is a front elevation view of an aperture bar for use with the shelf and shelving systems of FIGS. 1–6.
Figure 21:
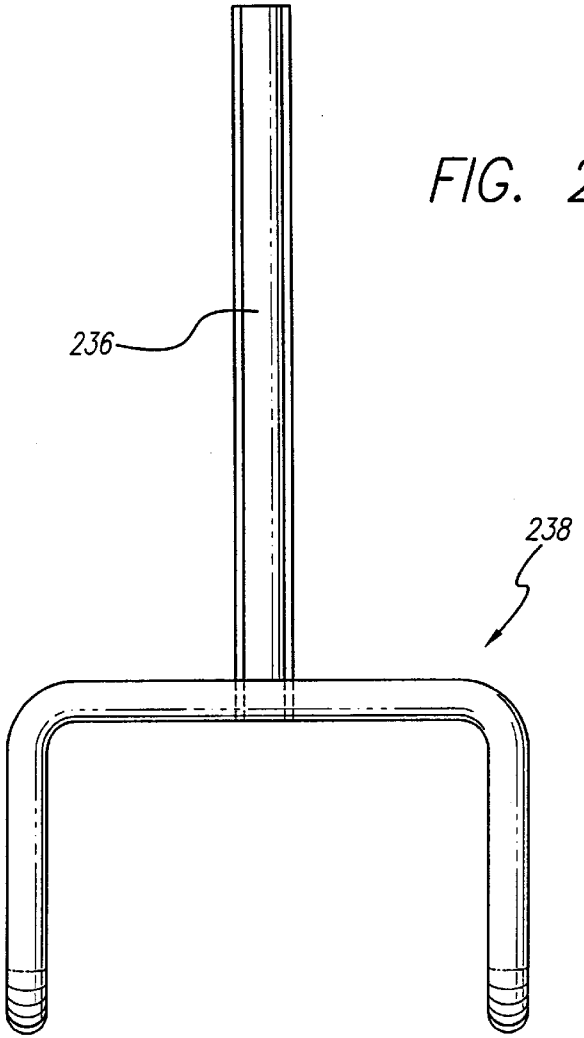
FIG. 21 is a rear elevation view of the divider of FIG. 19.
Figure 20:
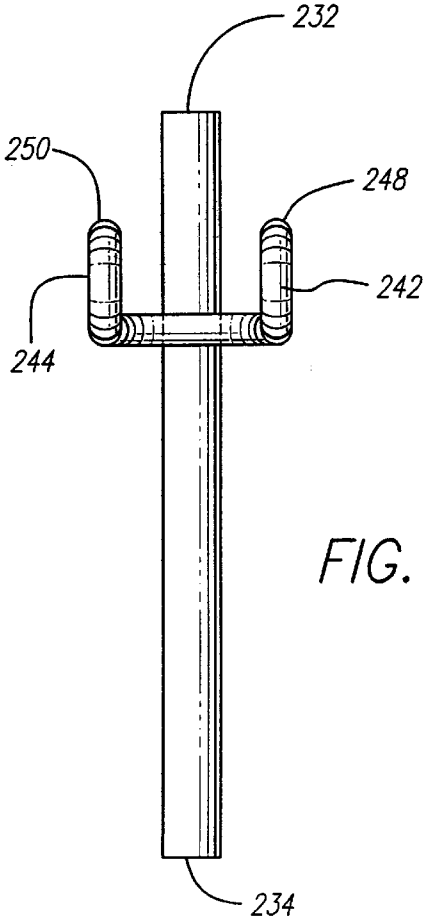
FIG. 20 is a front elevation view of the divider of FIG. 19.

The shelf assembly 72 also preferably includes a front product stop 182 (FIG. 1) and also preferably includes a rear product stop 184 (FIGS. 1 and 6) for reducing the possibility of product falling from the shelf assembly. Each of the front and rear product stops can be positioned at any number of selected positions above the wires 124, but the rear product stop 184 is preferably positioned relatively low to permit easy re-stocking of the shelf from the rear. The front product stop 182 is preferably adjustable in vertical position above the wires 124 so that the product stop can be positioned above the center of mass of the product to be placed on the shelf In one preferred embodiment, the front product stop 182 is supported by an adjuster bracket or plate 186 on each side of the shelf assembly. The right adjuster bracket 186 is preferably positioned within and supported by the continuous wire 182 and the left bracket configured in the same way. The adjuster brackets 186 preferably include a plurality of slots 188 for receiving respective upper and lower key hole locking tabs 190 and 192, respectively, and upper and lower locking tabs 194 and 196, respectively, on the opposite side of the product stop 182 from the locking tabs 190 in 192. The tabs 194 and 196 preferably extend into corresponding slots in the left adjuster bracket 186 and the locking tabs 190 and 192 extend into corresponding slots in the right adjuster bracket 186. Upon assembly, the locking tabs 190 and 192 are inserted into their corresponding slots, after which tabs 194 and 196 are inserted into their corresponding slots. The product stop 182 is then moved to the left, as seen in FIG. 18, until the product stop hits the left side product stop. A locking pin 198 is then inserted through holes in the tabs 190 and 192 to prevent the product stop 182 from moving to the right and disengaging from the left side product stop. The pin 198 can be tethered to the product stop 182 (not shown).

The front product stop 182 is preferably sufficiently strong to absorb impact from large and small containers, including beverage containers, when the shelf is placed at angle for gravity feed. In the preferred embodiment, the product stop 182, as well as the rear product stop 184, are formed at least from an angle bar, and preferably from metal sheet formed into a square comered, U-shaped bar for structural integrity. The shape also makes it easier to mount legs 200 and 202 for the locking tabs.

The shelf assemblies 72 also preferably include removable dividers 204 or other product separators or guides for guiding product from the rear of the shelf toward the front and for keeping product aligned on the shelf The dividers are preferably positionable at a number of different locations on the shelf, after which the dividers preferably remain fixed in positioned and stable until removed or repositioned. The dividers are also preferably variable or adjustable in height above the wires of the shelf, to account for different sizes of product.

Figure 15:
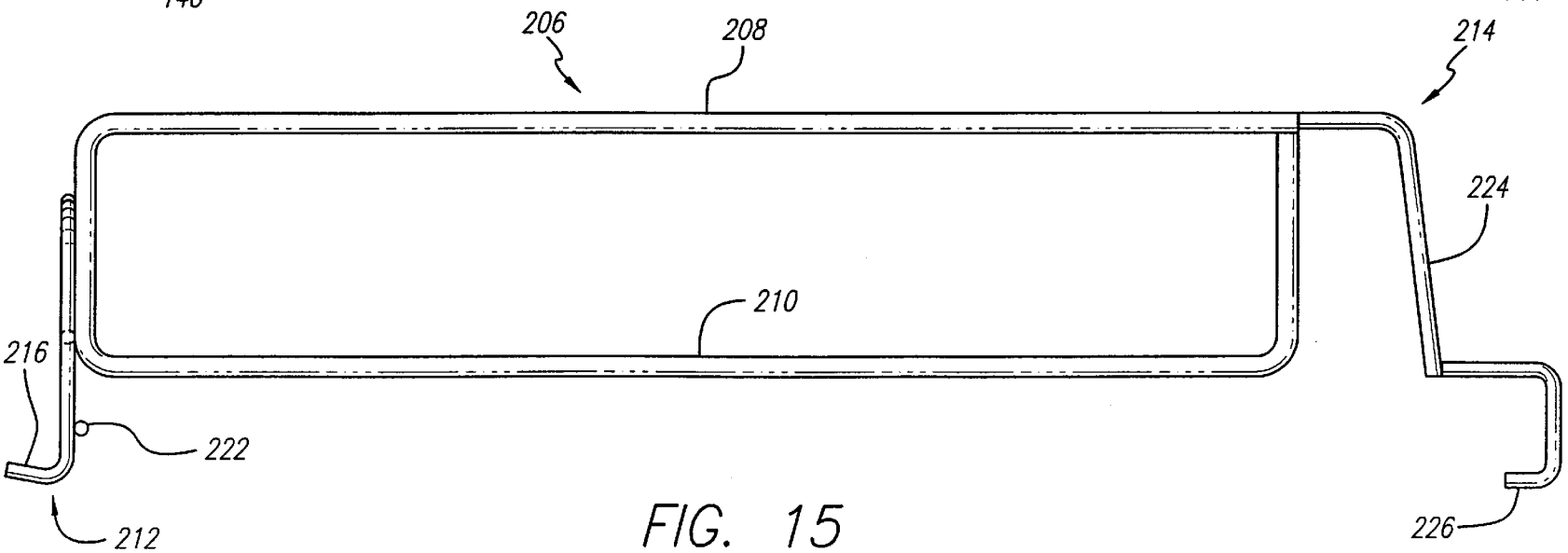
FIG. 15 is a side elevation view of a divider in accordance with another aspect of the present invention for use with the shelving system of the present inventions.
Figure 10:
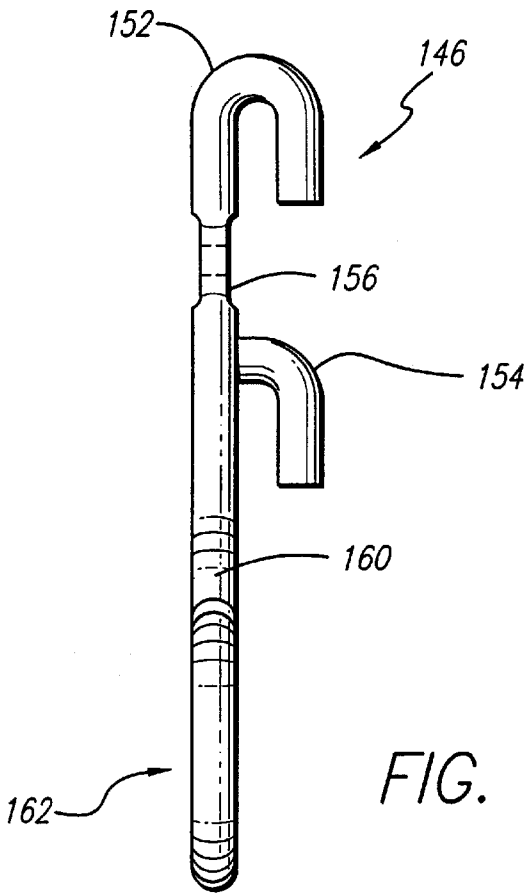
FIG. 10 is a left side elevation view of the shelf support element of FIG. 9.
Figure 9:
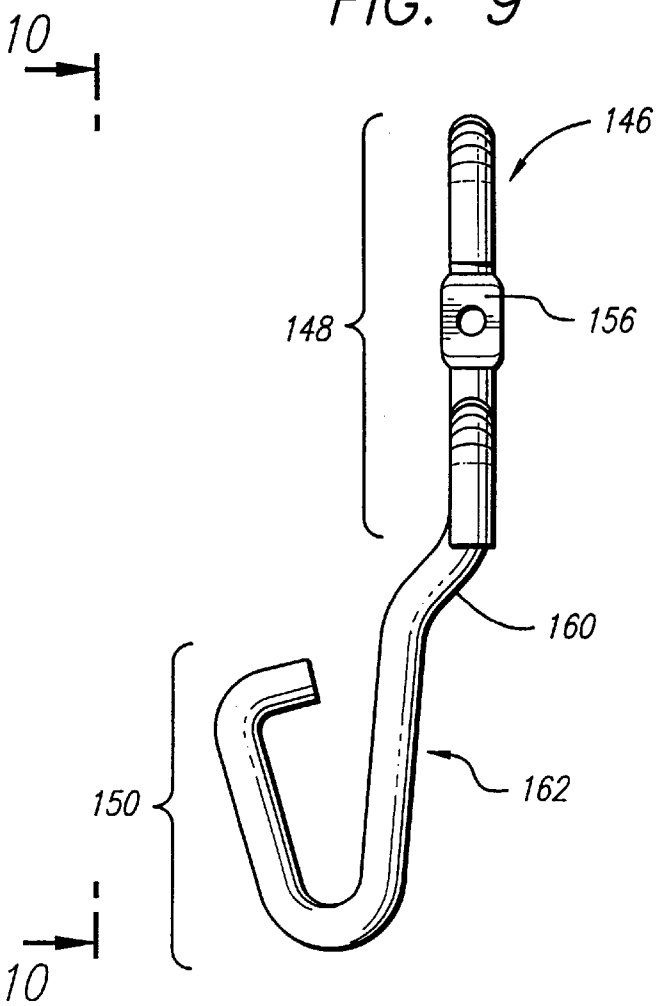
FIG. 9 is a front elevation view of a shelf support element in accordance with a further aspect of the present inventions.
Figure 11:
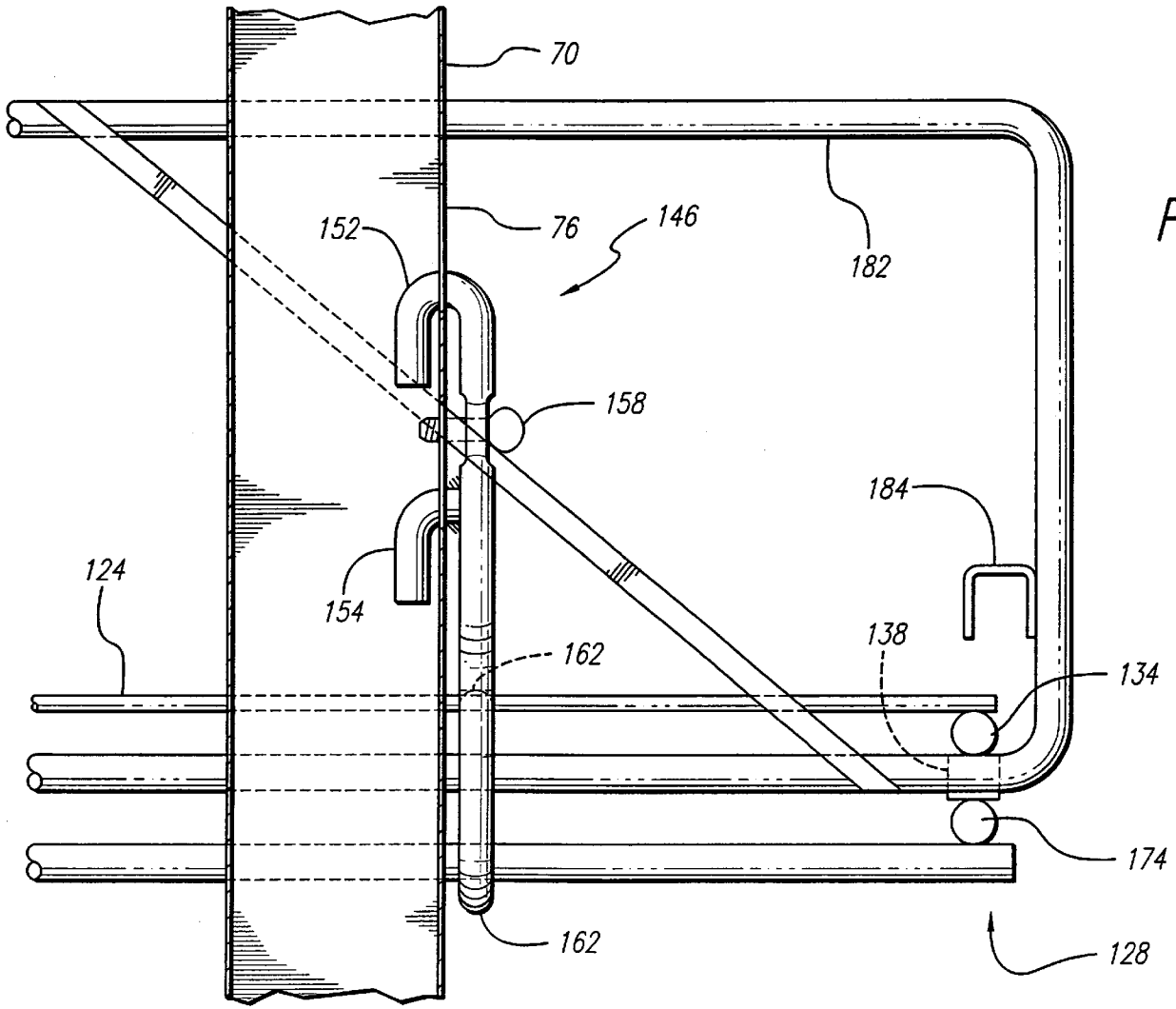
FIG. 11 is a left side elevation view of a portion of the shelving system of FIG. 2 with the shelf support element of FIGS. 9 and 10.
Figure 13:
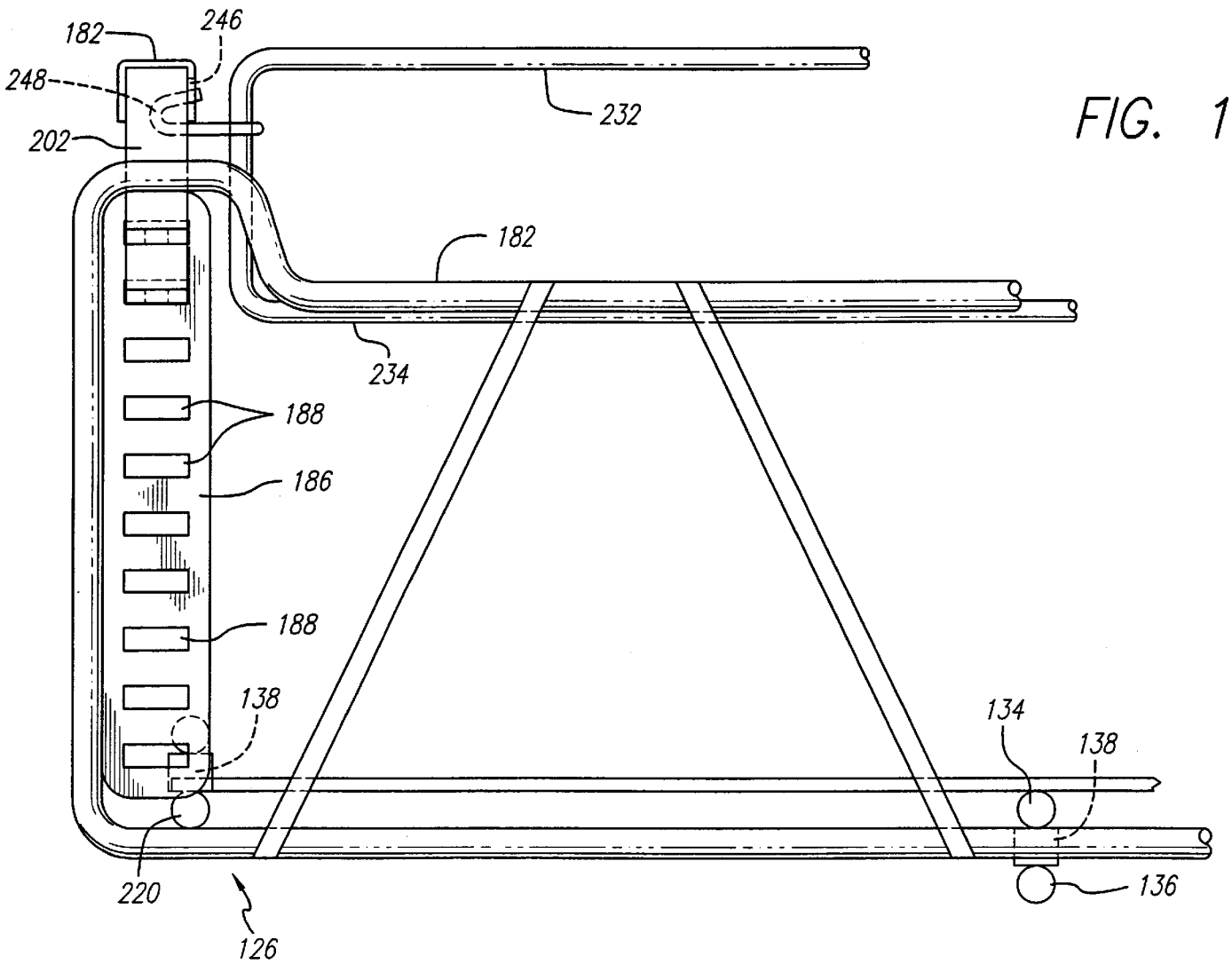
FIG. 13 is a side elevation and detail of the front part of the shelf of FIG. 6.
Figure 14:
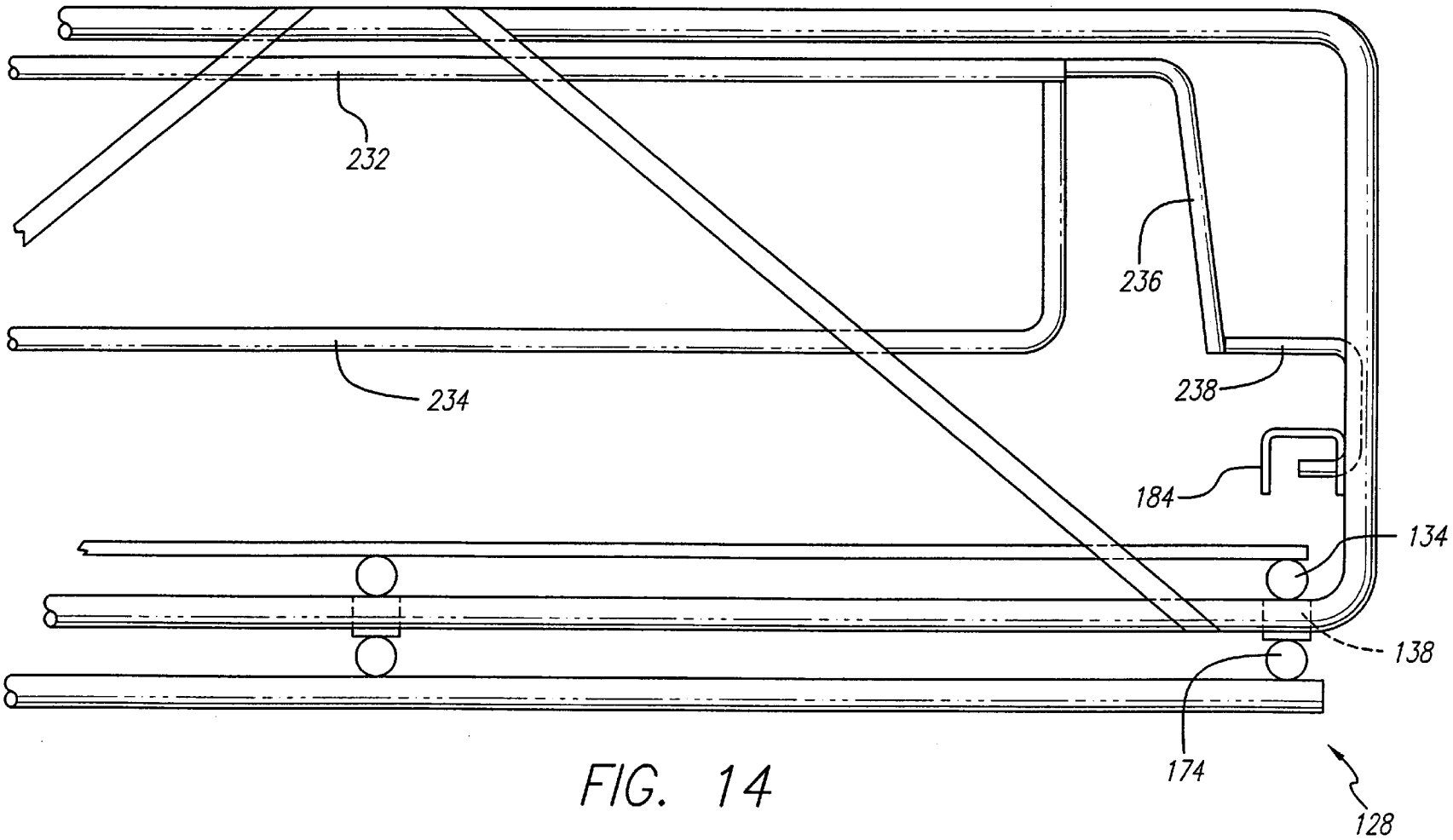
FIG. 14 is a left side elevation view of a portion of the shelf of FIG. 6.

In one embodiment of the shelf dividers 206, the divider includes a top rail 208, a bottom rail 210, a front attachment portion 212 and a rear attachment portion 214 (FIG. 15). The top and bottom rails are similar to conventional dividers made by Anthony Manufacturing Company, Inc. The front attachment portion 212 preferably includes a first under rail hook 216 and a second under rail hook 218 for extending under a lower cross bar 220 (FIG. 13) on the wire shelf. A divider cross bar 222 extends across and behind rail hooks 216 and 218 and is spaced sufficiently above the hooks so the cross bar 222 bears against one or more wires 124 when the hooks 218 and 216 are positioned under the cross bar 220. The positioning of the cross bar 222 and hooks 216 and 218 relative to each other preferably puts compression on the wire 124 and the cross bar 220 so as to firmly hold the divider at the front of the shelf. The two hooks 216 and 218 and the cross bar 222 stabilize the divider and minimize any side to side movement or wobble in the divider.

The divider 206 is also put under tension on the shelf by the rear attachment portion 214 having a rear tension arm 224 extending between the top rail 208 and a shelf hook 226 for engaging the rear of a shelf The shelf hook 226 may engage the shelf under the cross bar 174 or between the upper cross bar 134 and lower cross bar 174. Alternatively, the shelf hook 226 may be configured to engage openings in a rear product stop, described more fully below.

Figure 16:
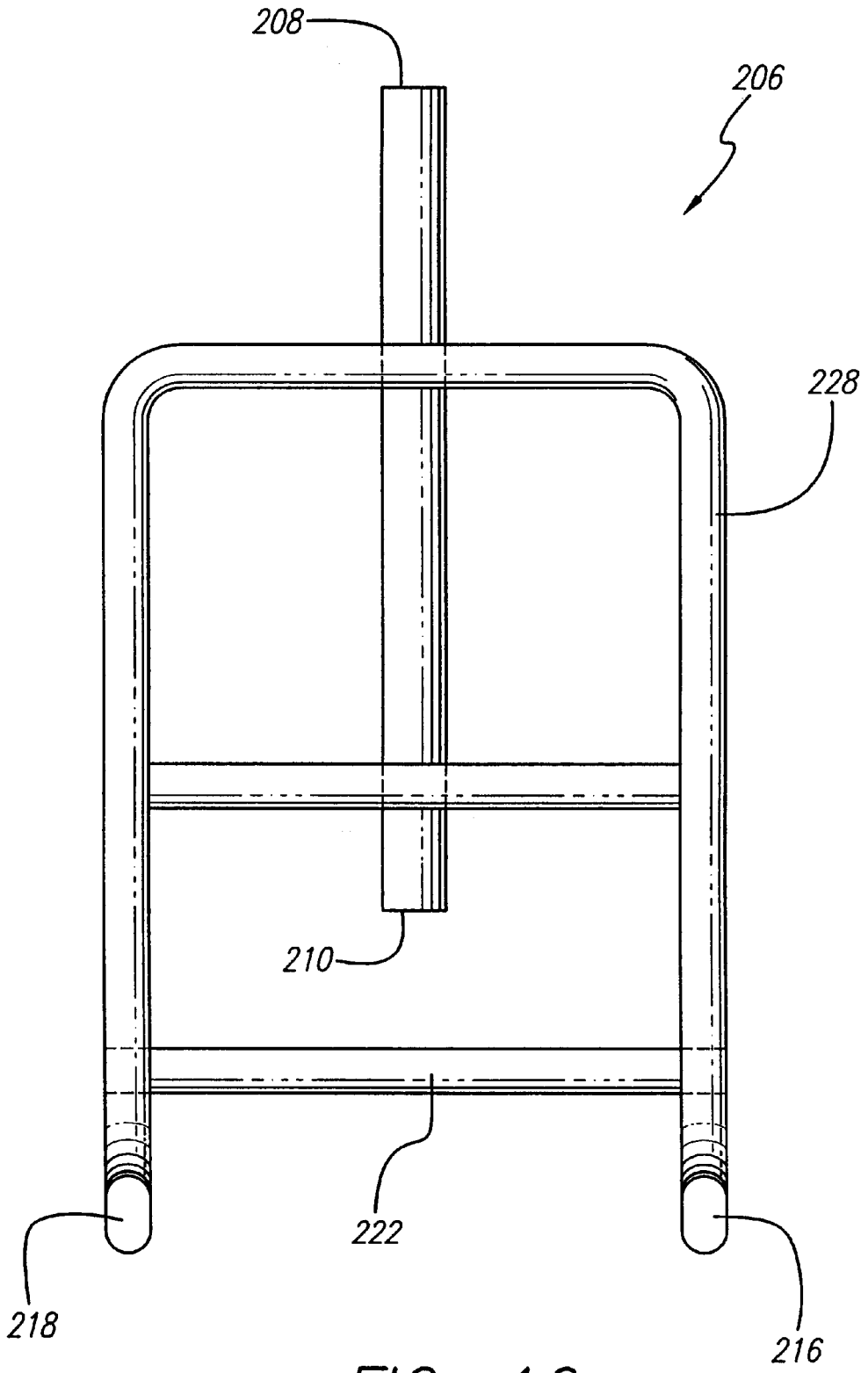
FIG. 16 is a front elevation view of the divider of FIG. 15.
Figure 17:
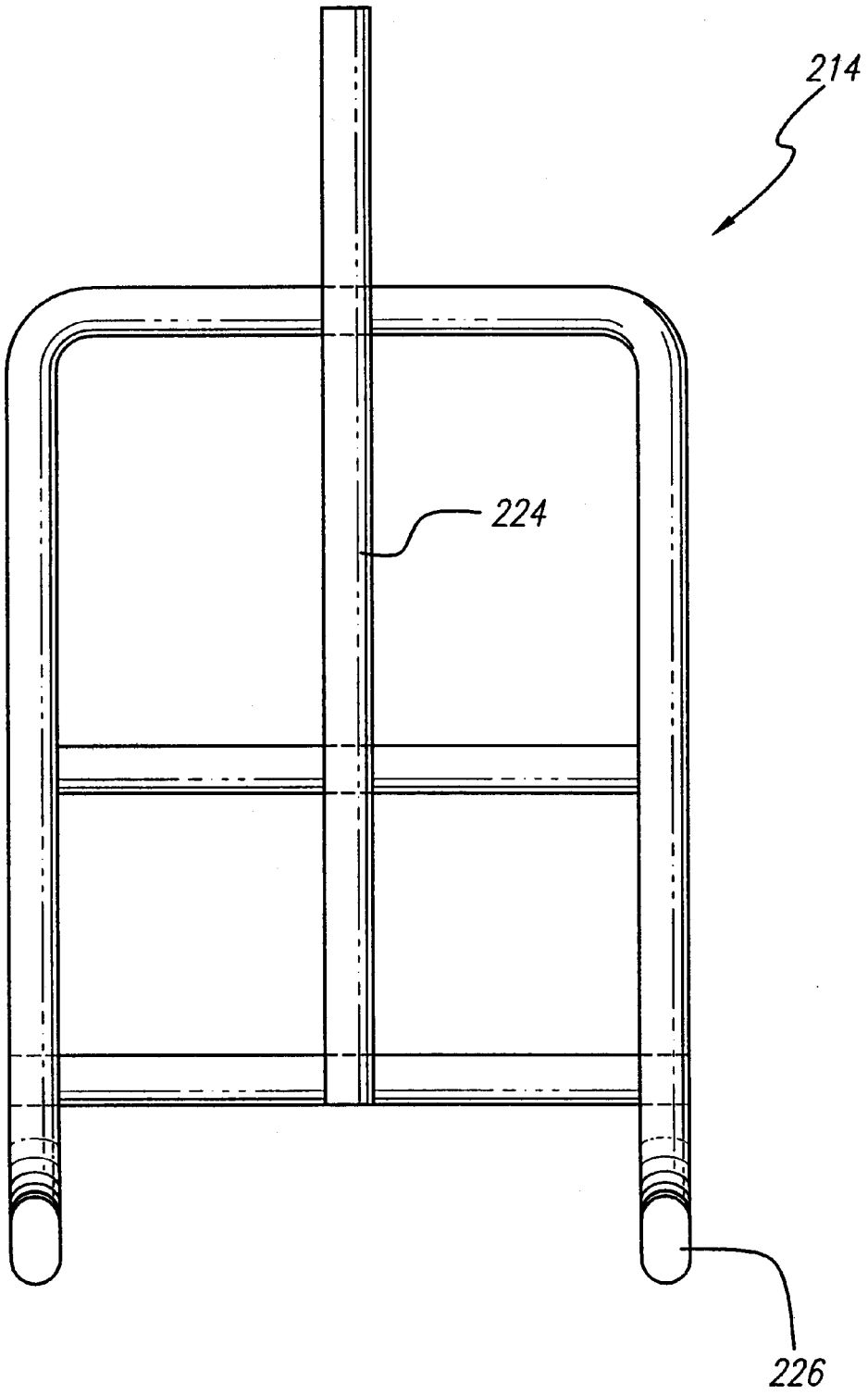
FIG. 17 is a rear elevation view of the divider of FIG. 15.

The divider 206 may also include front product stop bars 228 (FIG. 16) to serve the same function as the front stop bar 182 but for the adjacent lines of product on each side of the divider rails 208 and 210. The stop bars 228 provide a stop function that can be sized as a function of the height of the divider 206. Therefore, for a higher divider, the stop bars 228 are positioned higher with the divider so as to more effectively stop larger product. A number of dividers can be used on a given shelf assembly, and dividers can be sized differently. Different sizes of dividers on a given shelf assembly allow different sized product to be placed on the same shelf. As a result, the product stops on each divider can be configured specifically for the intended product size, which is particularly helpful for gravity feed shelves.

An alternative form of divider 230 (FIGS. 1, 13, 14, 18 and 19) mounts to the shelf assembly differently at the front portion of the shelf and omits a front stop in favor of relying on the front product stop 182 at the front of the shelf. The divider 230 includes a top rail 232, a bottom rail 234, and a rear tension arm 236 with a rear hook 238. The divider 230 includes a front engagement portion 240 having a right hook portion 242 and a left hook portion 244 for securely engaging and being supported by a divider support, such as that described more fully below. Two hooks are preferably included to increase the stability of the divider and to minimize the possibility of the divider moving from side to side or twisting.

Figure 7:
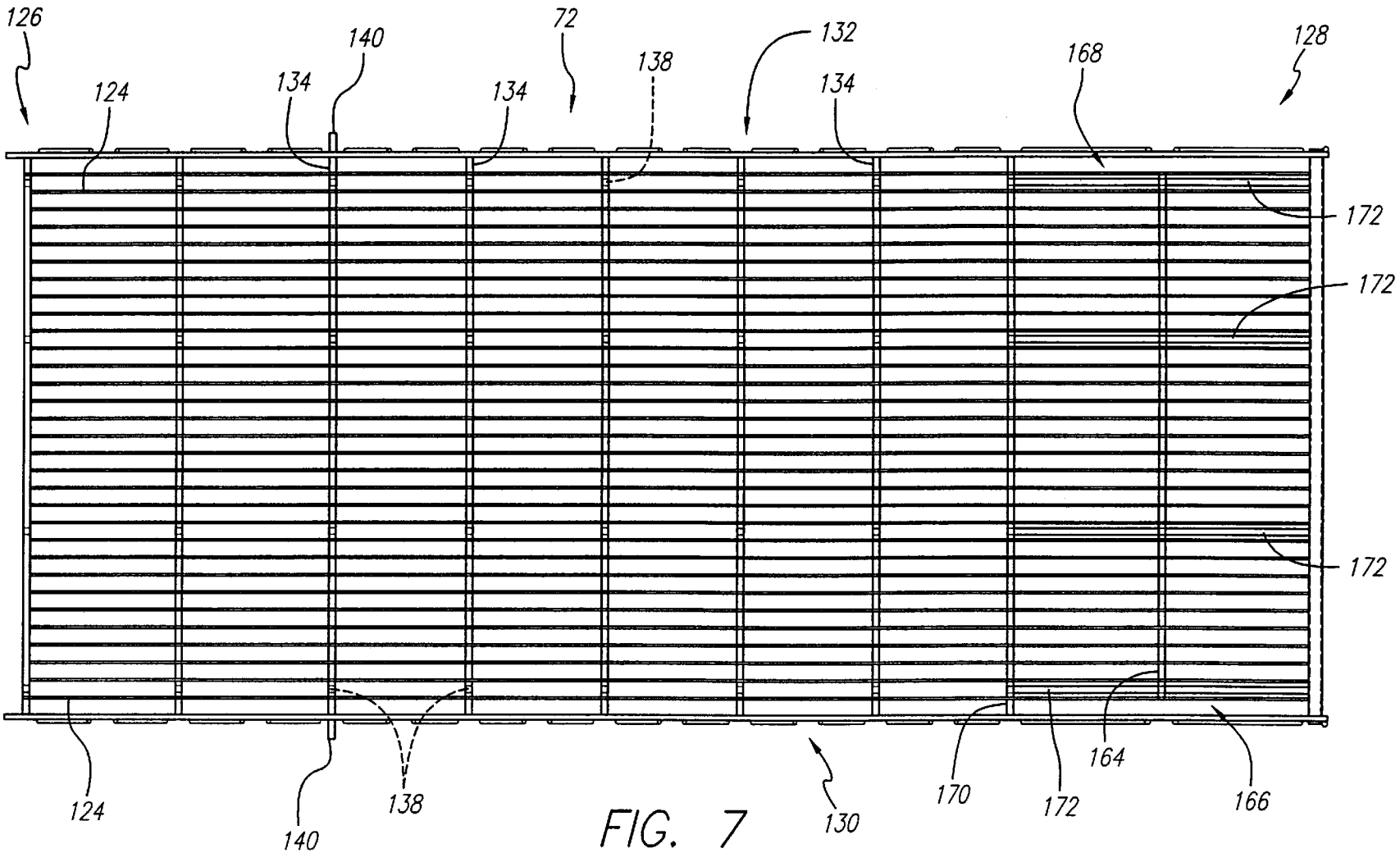
FIG. 7 is a top plan view of the shelf of FIG. 6.
Figure 8:
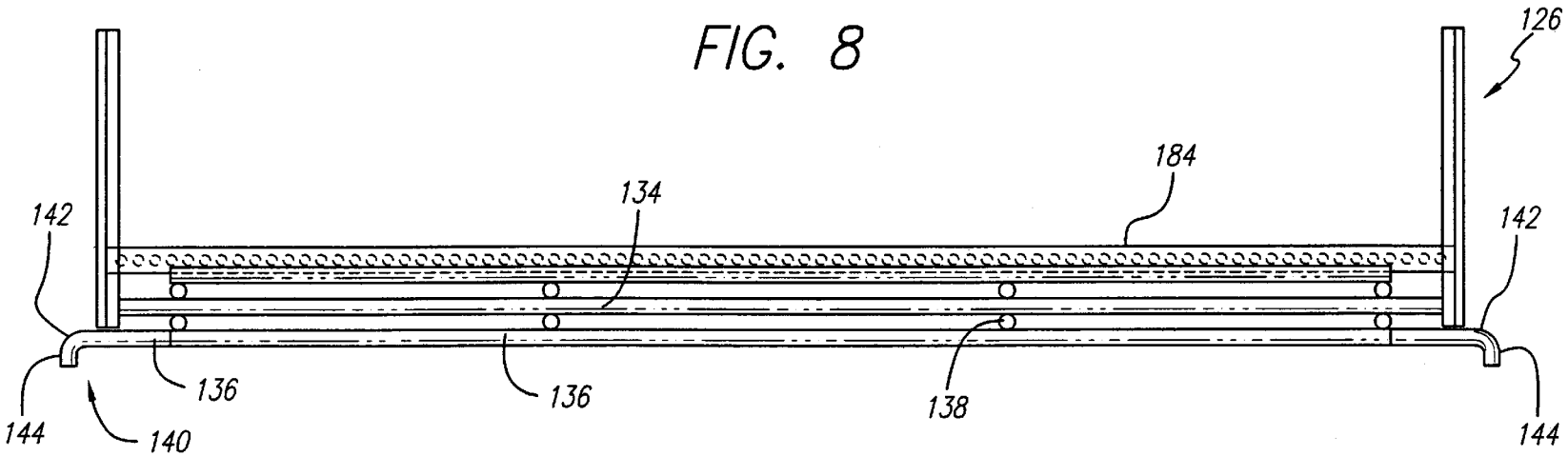
FIG. 8 is a is a front elevation view of the shelf of FIG. 6.

In a preferred embodiment, the front product stop bar 182 also serves as a support and locator for the dividers 230. In this embodiment, the front product stop bar 182 includes a plurality of engagement surfaces such as holes 246 for engaging the dividers 230 for supporting product. The holes 246 are preferably rearward facing and formed in the rear most surface of the product stop bar 182 so that the upward turning and rearward extending prongs 248 and 250 can extend through and engage two holes 246 on the product stop bar 182. The holes 246 are formed in the rear facing surface of the product stop bar 182 also to minimize the likelihood that the divider would disengage from the bar 182 if a product moved forward and struck the bar. Such an impact would tend to more securely engage the hooks in the holes 246. As can be seen in FIG. 7, the width in the horizontal direction between the vertical walls of the bar 182 should be sufficient to permit easy access for the prongs 248 and 250 to the holes 246. The rear hooks 238 also serve to bias the prongs 248 and 250 into engagement with the holes 246.

In a preferred embodiment, the rear product stop bar 184 includes a plurality of engagement surfaces such as holes 252 to support and position respective dividers 230. The dividers 230 and the rear product stop bar are preferably configured so as to place each divider 230 under tension and minimize any side to side movement under normal circumstances. As with the holes 246 in the front product stop bar 182, the engagement surfaces may take any number of configurations, such as scalloped edges, saw-tooth edges, ridges, grooves or other regular or irregular discontinuities. Preferably, the engagement surfaces are sufficiently defined to hold the divider under tension and to minimize the possibility of sideways movement under normal circumstances. Conversely, the product stop bars 182 and 184 can be formed with projections which engage openings or other surfaces formed in dividers. However, forming circular holes in the front and rear product stop bars is the preferred configuration.

By combining the product stop function and the divider support and stabilizing function in one element, namely the front product stop bar 182, the positioning of the front portions of the dividers 230 is made adjustable with the positioning of the product stop bar 182. However, it should be understood that the divider support function and the front product stop function can be accomplished with separate structures. Likewise with the rear product stop bar 184, but the divider support function of the rear product stop bar 184 is considered the more important function for the bar, especially when the shelf is angled downwardly toward the front. In this configuration, product is less likely to fall from the rear of the shelf These aspects of the inventions allow the shelf systems to accommodate many different sizes, widths, lengths and types of products and packaging, without having to expend excessive effort in readjusting hardware. Each shelf can have a unique configuration to accommodate a large variety of product shapes, sizes and types, and a shelf can accommodate such variety on a single shelf as well. The shelf system is easy to assembly and use, and easy to adjust for different situations. The shelving system can also be adopted for a wide variety of shelf sizes, shapes and styles.

The components of the shelving system can be formed from a wide variety of materials and have a wide variety of configurations. The shelf materials can be formed from conventional metals and plastics, in a manner similar to present shelf systems. The materials are preferably selected to conform to any regulations that may exist for the particular application.

Figure 25A:
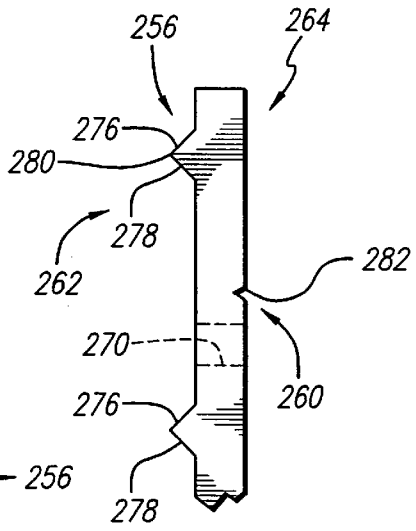
FIG. 25A is a partial end elevation of the glide sheet of FIG. 25 showing ridges, an opening and a groove for use in sizing the sheet.
Figure 25:
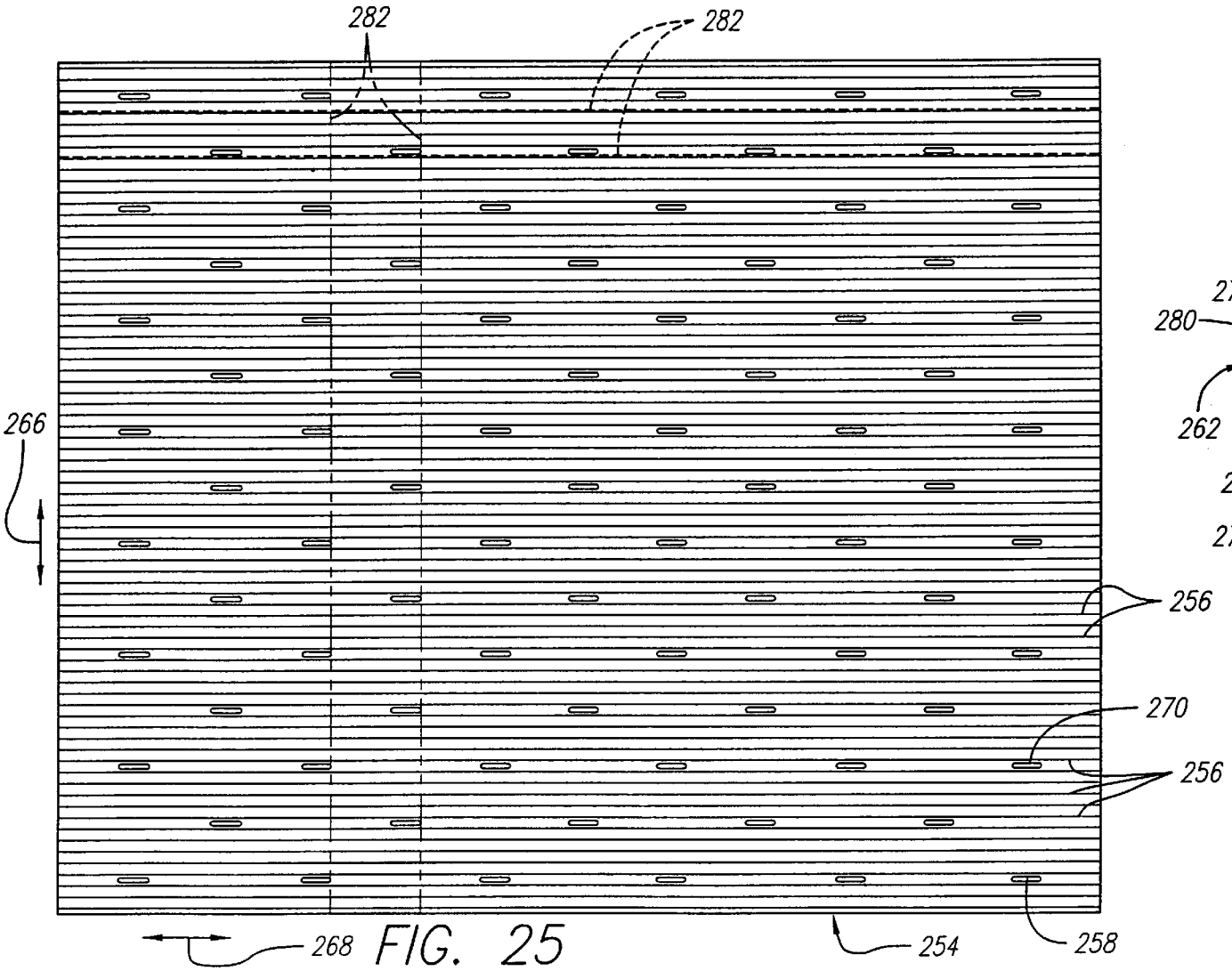
FIG. 25 is a plan view of a glide sheet for use in supporting product on a shelf on which the de sheet rests and which can be used on flat shelving or in gravity feed systems.
Figure 26:
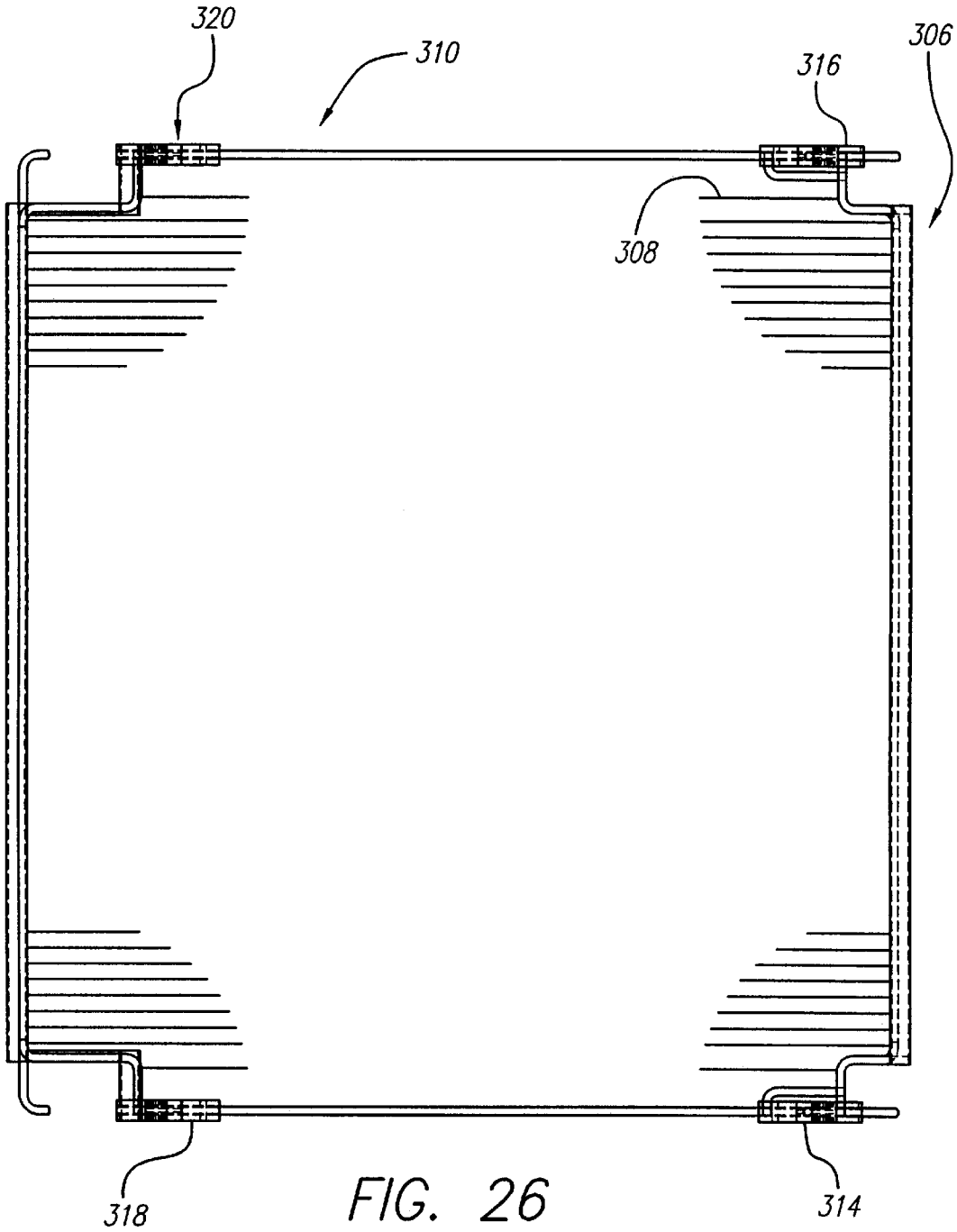
FIG. 26 is a plan view of a conventional wire shelf retrofitted with a product stop and means for accepting and holding shelf dividers.
Figure 28:
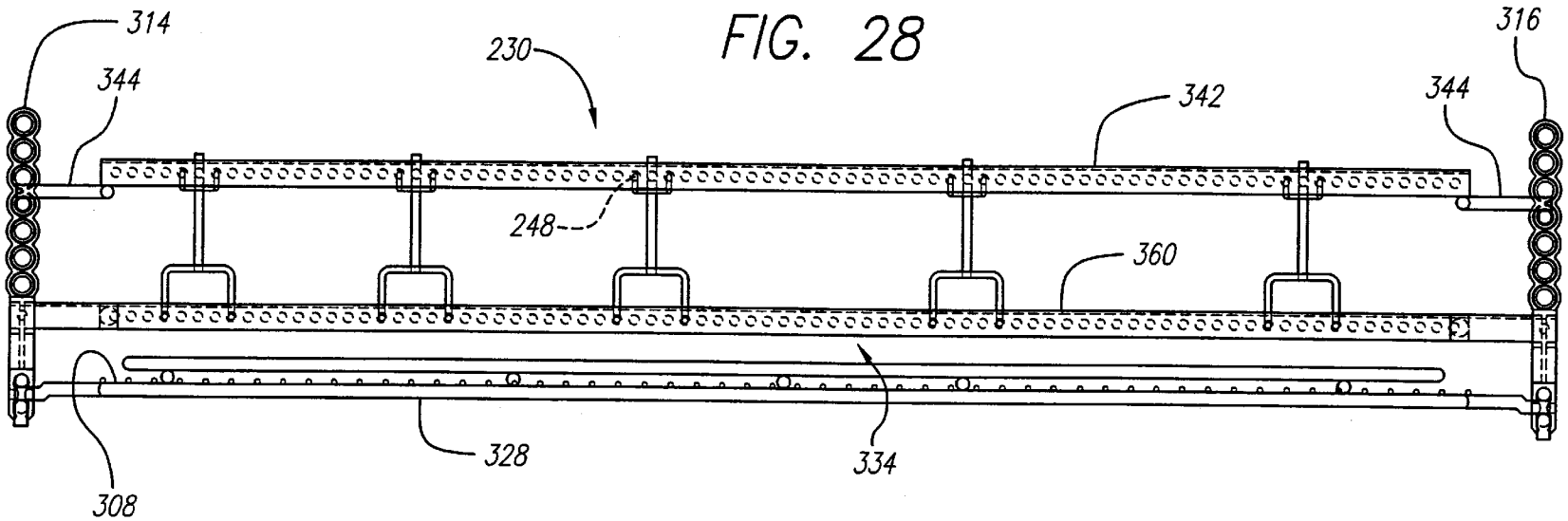
FIG. 28 is a front elevation view of the shelf assembly of FIG. 26 showing dividers positioned on the shelf
Figure 30:
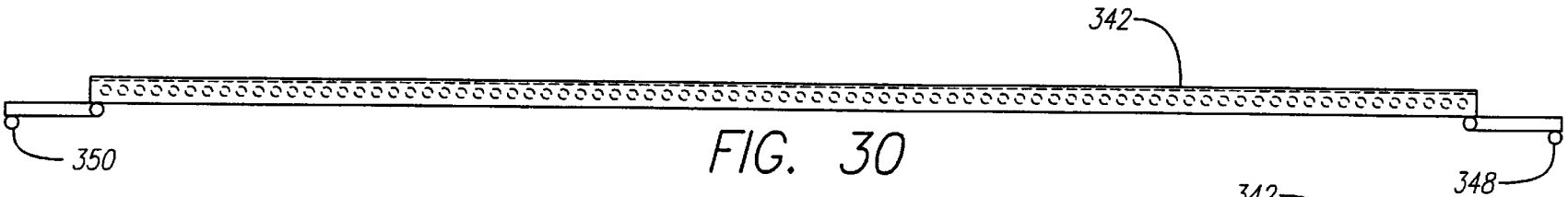
FIG. 30 is a front elevation view of the stop of FIG. 29.
Figure 31:
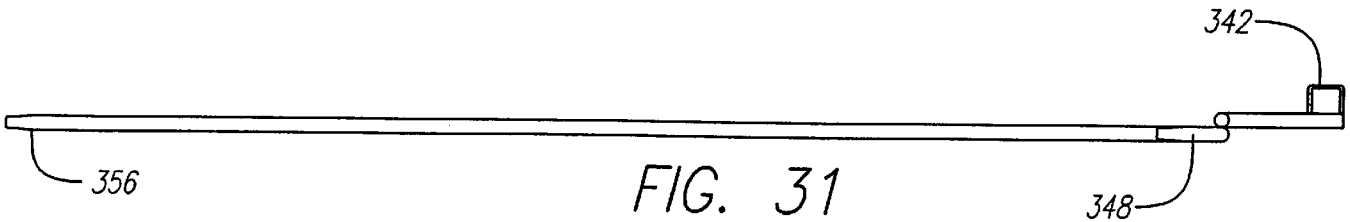
FIG. 31 is a side elevation view of the stop of FIG. 29.
Figure 29:
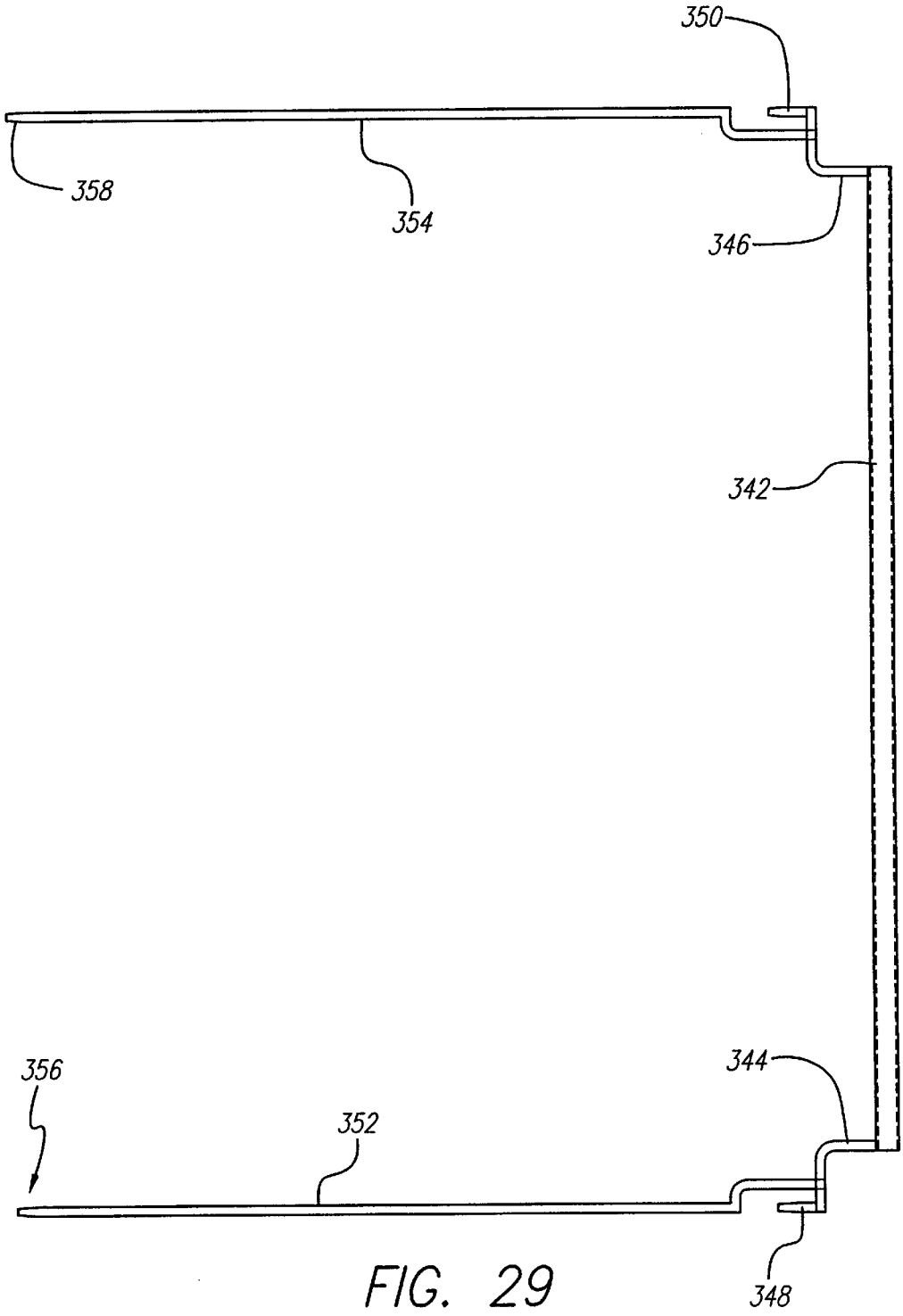
FIG. 29 is a plan view of a combined front and side product stop and incorporating surfaces for accepting and holding shelf dividers.
Figure 32:
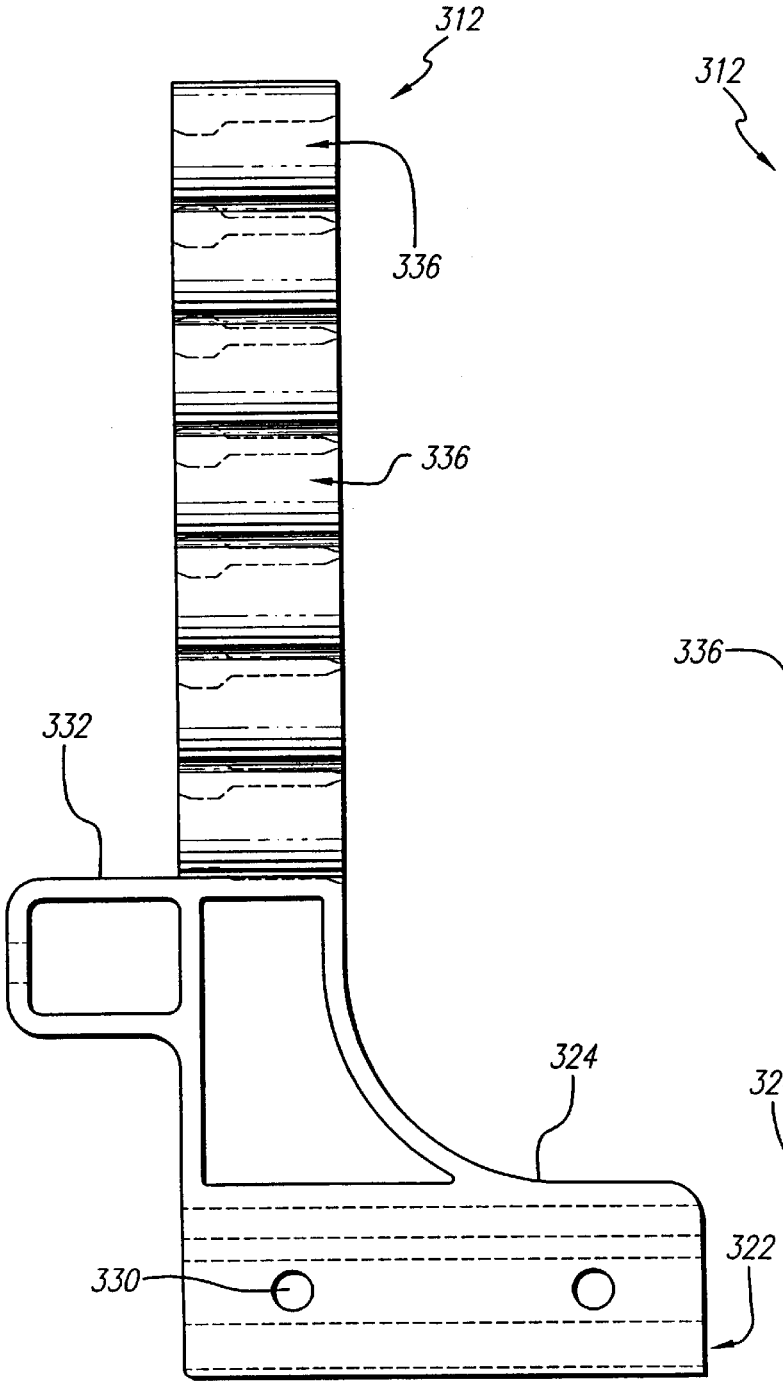
FIG. 32 is a side elevation view of a bracket for use in assembling the shelf assembly of FIG. 26, and which can be used to retrofit existing shelves.
Figure 33:
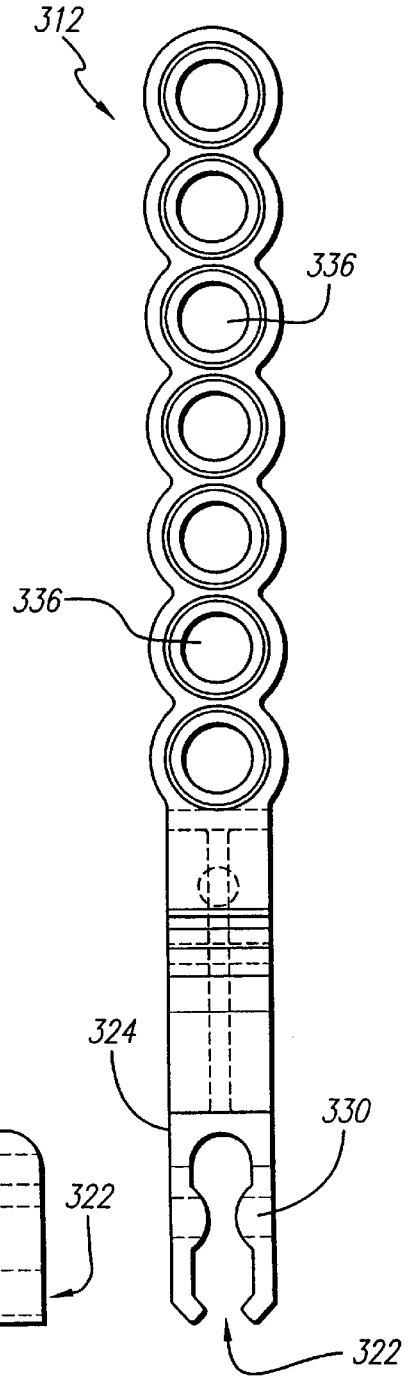
FIG. 33 is a right side elevation view of the bracket of FIG. 32.
Figure 34:
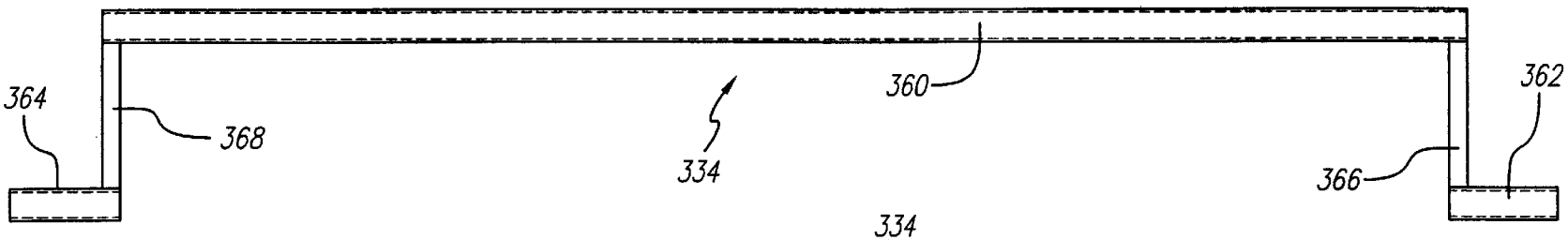
FIG. 34 is a top plan view of a rear product stop and means for supporting the rear portions of shelf dividers.
Figure 35:
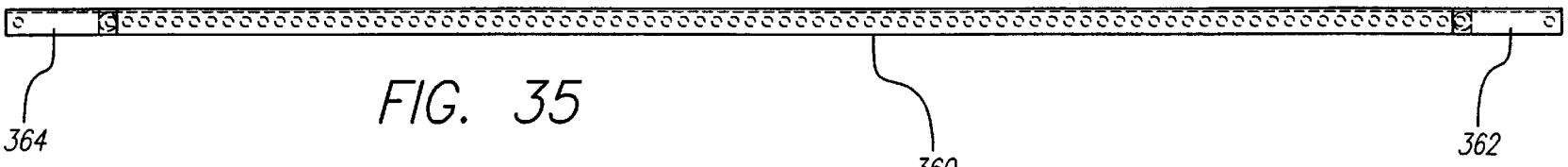
FIG. 35 is a front elevation view of the rear product stop of FIG. 34.
Figure 36:
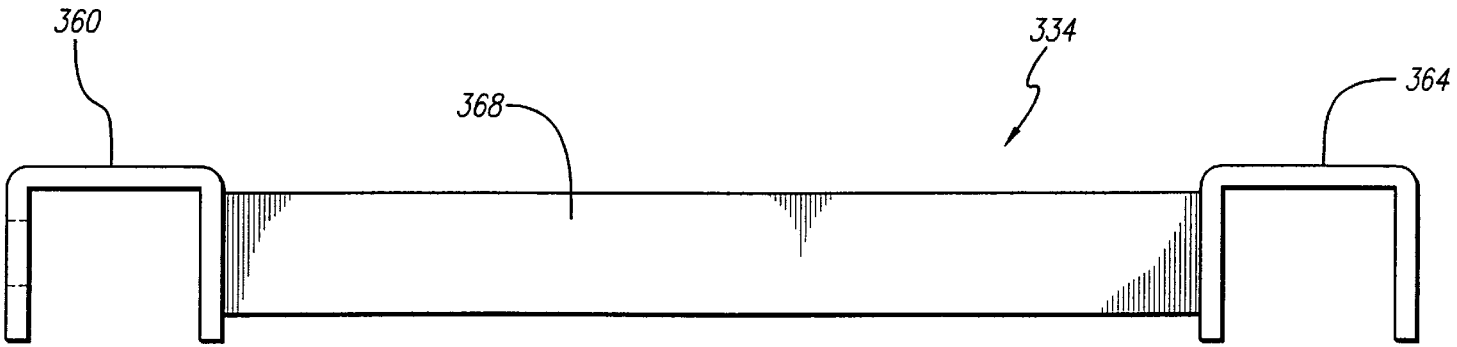
FIG. 36 is a right side elevation view of the stop of FIG. 35.
Figure 42:
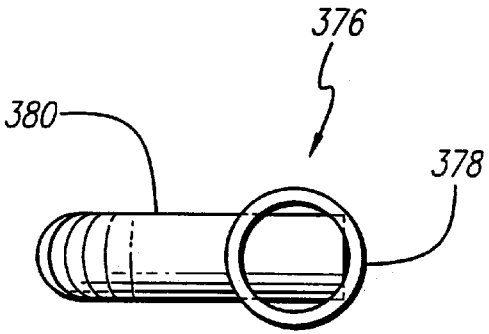
FIG. 42 is a top plan view of the bracket of FIG. 40.
Figure 41:
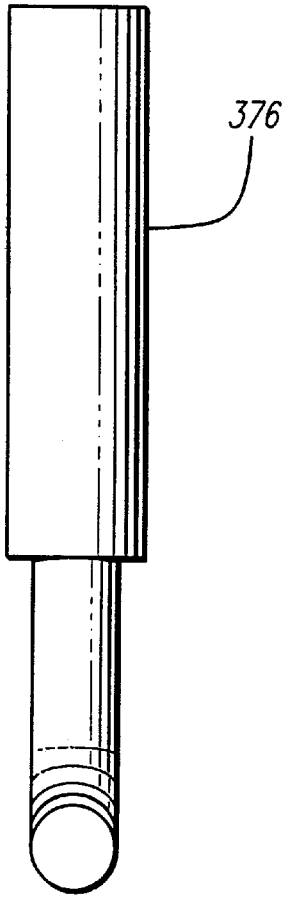
FIG. 41 is a rear elevation view of the bracket of FIG. 40.
Figure 40:
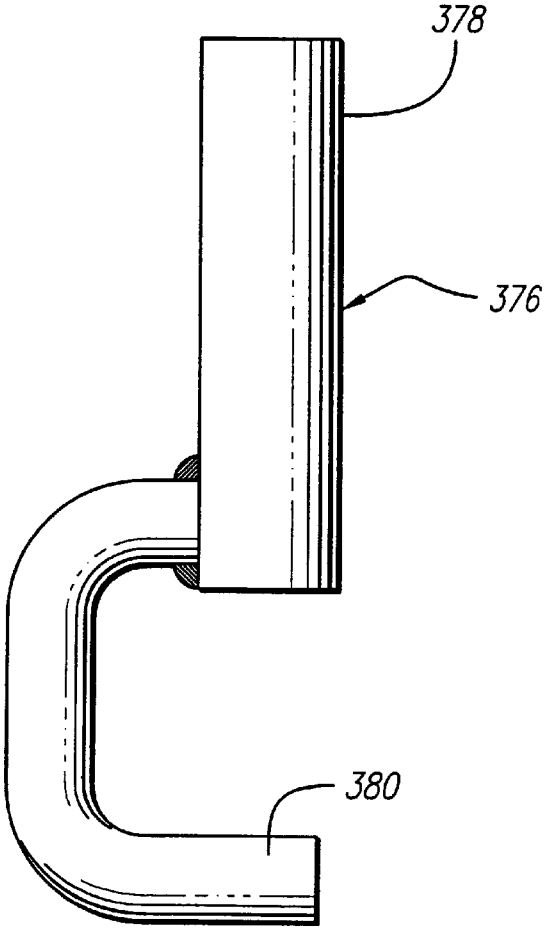
FIG. 40 is a side elevation view of a mounting bracket that can be used to mount alternative front and/or rear product stops on an existing shelf
Figure 43:
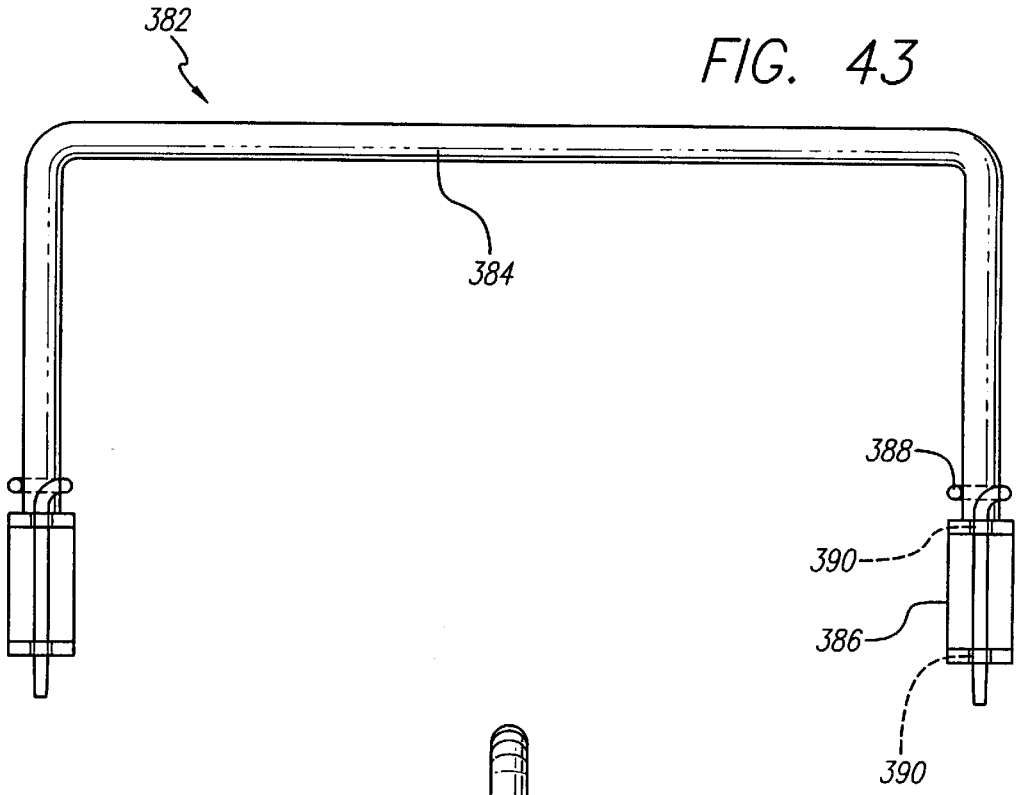
FIG. 43 is a front elevation view of a further alternative front or rear product stop with integral mounting bracket for use on a shelf
Figure 44:
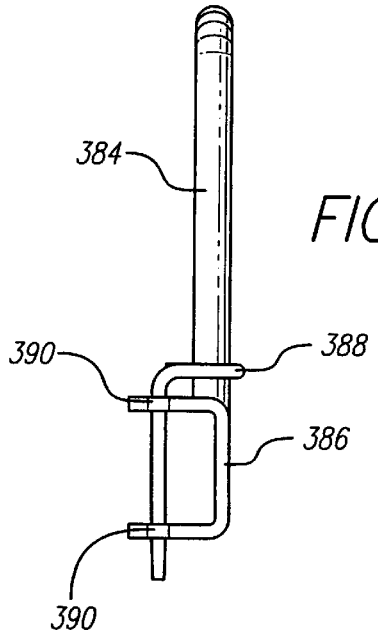
FIG. 44 is a side elevation view of the product stop of FIG. 43.
Figure 45:
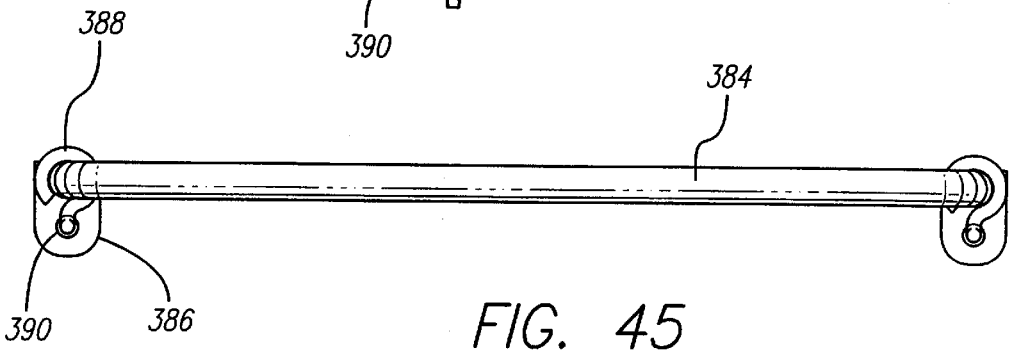
FIG. 45 is a top plan view of the product stop of FIG. 43.

In a preferred embodiment, the rear product stop bar 184 is fixed to the shelf assembly and spaced a distance above the wires 124 (FIG. 18) to permit a glide or slide sheet 254 to be slid under the rear product stop bar 184 and over the wires 124 for product to rest on. The glide sheet 254 (FIG. 25) preferably includes a series of ridges 256 for supporting product, especially product with irregular bottom surfaces, such as star-bottom beverage containers. The glide sheet 254 is preferably formed from a high impact plastic having a relatively low coefficient of friction, to permit containers and other products to slide easily over the surface, especially in a gravity feed arrangement. Apertures or openings 258 are formed through the thickness of the glide sheet 254 to permit spilled product or food particles to pass through the sheet and to facilitate cleaning of the sheet. The sheet preferably includes scores or grooves 260 cut or formed in the bottom surface of the sheet to allow severing or breaking of sheet portions from the main glide sheet so as to permit formation of sheets having a standard dimension.

The shelf platform is preferably formed as a relatively planar sheet having a first surface 262 which may be considered a top surface, and a second surface 264, which may be considered a bottom surface. The first and second surfaces may define a thickness of the sheet establishing a standard or baseline for considering the other features of the shelf platform. The shelf platform preferably extends laterally, in the direction shown by arrow 266 and longitudinally in the direction of arrow 268. In one preferred embodiment, the shelf platform extends laterally the full extent of the widthwise dimension of a single shelf and longitudinally the depth or lengthwise dimension of a shelf Where the shelf is not entirely square or rectangular, the shelf platform is preferably cut or shaped so as to rest on the shelf within the top perimeter wire of the shelf. The thickness of the shelf platform is preferably selected so as to provide sufficient impact resistance considering the type, size and weight of the product to be supported and strong enough to support product of a foreseeable size and weight. Where the thickness of the shelf platform is approximately the same as the wire diameter of the top perimeter wire, the diameter of the top perimeter wire may be increased to still provide a rim or edge for the shelf, or a separate edge can be added to the shelf to reduce the possibility of product inadvertently falling from the shelf One or more oval walls 270 are preferably formed in the sheet or shelf platform and extend from the first surface to the second surface for defining the openings 258 for allowing air flow through the sheet. The openings may take any number of shapes and dimensions, but are preferably sized and positioned frequently enough along the sheet to facilitate air flow throughout a refrigerated display case. In the preferred embodiment, the opening is approximately 1 inch long and 0.156" inch in width. The openings are preferably oriented to extend longitudinally of the sheet in the direction of arrow 268. Adjacent ends are preferably spaced about 1.5 inches apart so that the centers are approximately 2.5 inches apart. The outermost openings adjacent the forward and rearward ends of the shelf platform are preferably spaced 1 inch to 2 inches away from the respective edges.

The shelf platform also preferably includes a plurality of protrusions 256 extending upwardly from the first surface of the sheet in a direction away from the first surface and away from the second surface, and preferably extending longitudinally the entire length of the sheet. The protrusions 256 are preferably triangular in cross-section and extend to a well-defined point opposite the top surface. The protrusions may be considered bumps, ridges, rises, peaks, projections, rails or tracks on which the product rests and along which the product may slide either by gravity or by being pushed or pulled along the sheet. While the protrusions are preferably continuous in the longitudinal direction, they may be discontinuous at random or selected points in the longitudinal direction so as to reduce or modify the ease with which product can slide along the protrusion.

While it is possible that the protrusions may have a rounded top, or may even have a relatively flat top surface to form a rail or a track along which product may slide, the protrusions are preferably defined by sides meeting at a point and an angle of approximately 120°. The peaks are preferably defined by substantially straight sidewalls 276 and 278 extending upwardly to join at a peak 280. The peaks preferably extend longitudinally parallel to each other and are preferably spaced approximately 0.315 inch apart. A relatively well defined point will reduce the frictional engagement between the product packaging and the points on the shelf platform sheet and permit easier movement of the packaging along the shelf platform in the longitudinal direction. Specifically, the shelf platform is placed on the shelf in such a way that the protrusions extend longitudinally of the sheet, or from front to back. In this configuration, product can easily slide to the front of the shelf either by gravity or by being pushed or pulled by stacking personnel. For example, where the shelf is loaded from the back, newer product is loaded onto the shelf from the back of the shelf and the product pushed toward the front of the shelf for display. With a relatively easy sliding or gliding surface for the product, the product is less likely to catch, bind or stop on the shelf platform, and therefore, less likely to tumble or fall off the shelf as a result of being pushed from behind by other product. While it is possible that the protrusions can be positioned on the platform so as to be not precisely parallel to a straight front-to-back line on the shelf, the protrusions are preferably oriented perpendicular to the front and back edges of the shelf and exactly parallel to a straight line extending from front to back in the display case. Orienting the projections so as to be more or less non-parallel with a front-to-back line would inhibit easy movement of the product along the shelf and would tend to guide the product in the direction of the protrusions toward one side of the shelf or another. While it is possible that product can be intentionally guided diagonally across the shelf from back to front, it is presently preferred that product be directed along a straight line from the back to the front of the shelf The material of the shelf platform is preferably formed from a relatively strong and rigid plastic, such as high impact polystyrene. The plastic preferably includes a lubricant within the material, such as approximately 5 percent (5%) silicone lubricant. An example of such a material is Ferroflo Product No. SPS05PK02. This material provides suitable strength, rigidity and impact resistance and also provides a relatively low friction surface. It should be understood that the phrase "low friction surface" is used in the context of the material as well as in the context of the type of packaging that will be placed on the shelf platform. The shelf platform material will preferably be used with plastic beverage containers and similar packaging, such as made from high density polyethylene. The material can also be used with beverage containers made from aluminum such as soda and other beverage cans, and the like. A different material can be used for the shelf platform, and may depend on the type of packaging material used with the product displayed.

The shelf platform also preferably includes one or a plurality of weaknesses, discontinuities, surface brakes, grooves, channels or cuts 282 formed in the second or bottom surface of the sheet so that the bottom of the groove extends toward the top surface, and extending longitudinally of the sheet. The cuts are preferably formed in the bottom surface so as to provide weak points in the plastic to facilitate breaking of the sheet into smaller sections to accommodate shelf width. The cut may be formed as a V-shape groove defining an angle of approximately 60° and extend from the second surface toward the first surface a depth of approximately 0.015 inch. With an overall thickness of the sheet between the first and second surfaces of approximately 0.065 inch, the depth of the cut may range from 10 to 40% of the thickness of the sheet. The protrusions may extend approximately 0.035 inch above the first or top surface, and may add as much as 35 to 75% of the sheet thickness to the overall thickness of the shelf platform. The sheet may be as thick as 0.250 inch and the peaks may be as high as 0.125 inch.

The cuts 282 may be placed or formed in the sheet at locations based on available shelf widths. The preferred maximum width of a shelf platform may correspond to the maximum shelf width, and the cuts 282 may be spaced from one longitudinally extending edge of the shelf platform to correspond with a smaller shelf sizes that may be available at the time. Alternatively, or additionally, the cuts 282 may be spaced apart so as to permit breaking the sheet into longitudinally extending sections having width corresponding to a single product width. These sections may then be placed in tracks defined by the width of the product. However, for ease of cleaning and assembly, the shelf platform preferably extends the entire width of a shelf.

Figure 23:
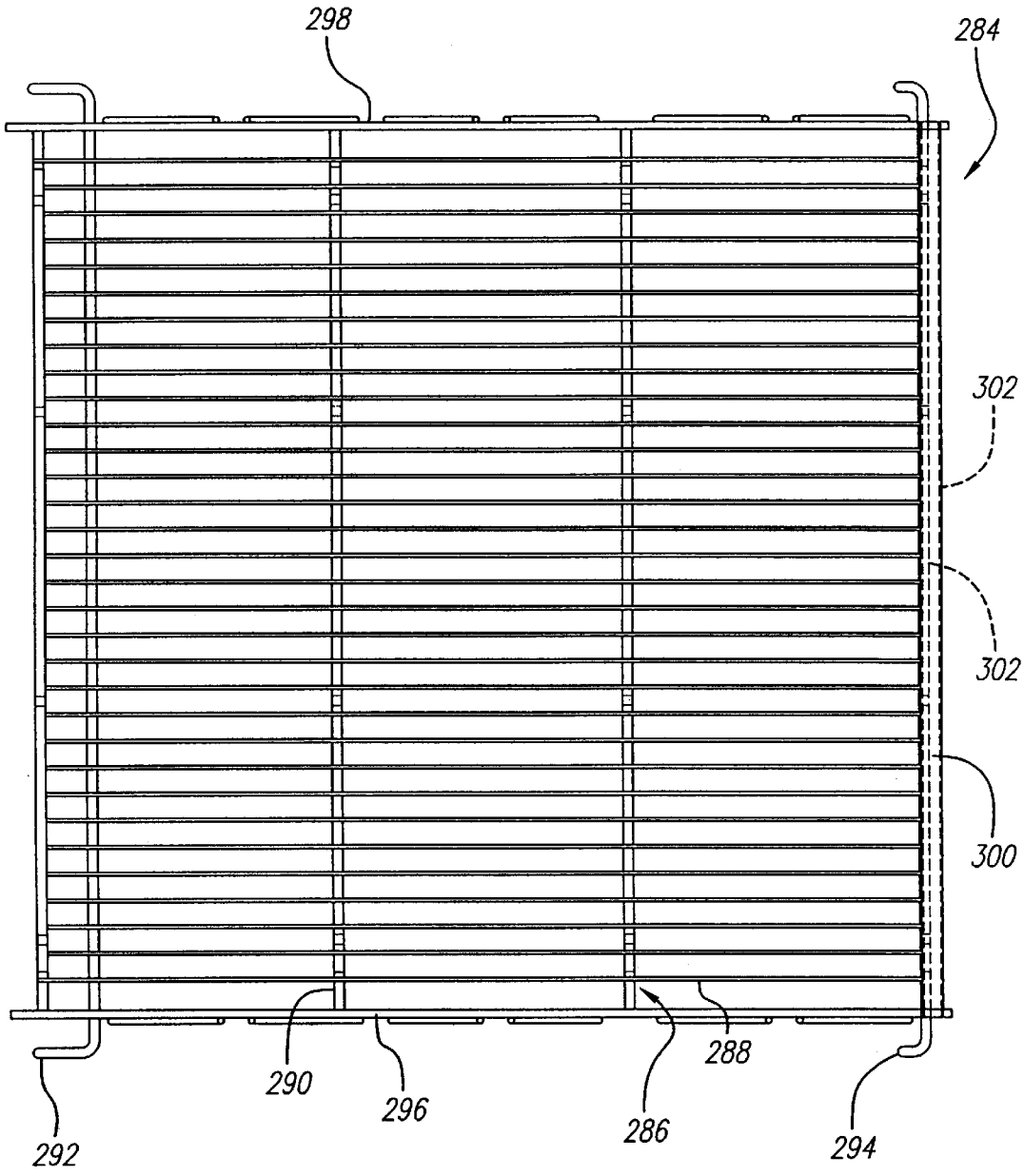
FIG. 23 is a top plan view of a shelf in accordance with a further aspect of the present inventions.
Figure 24:
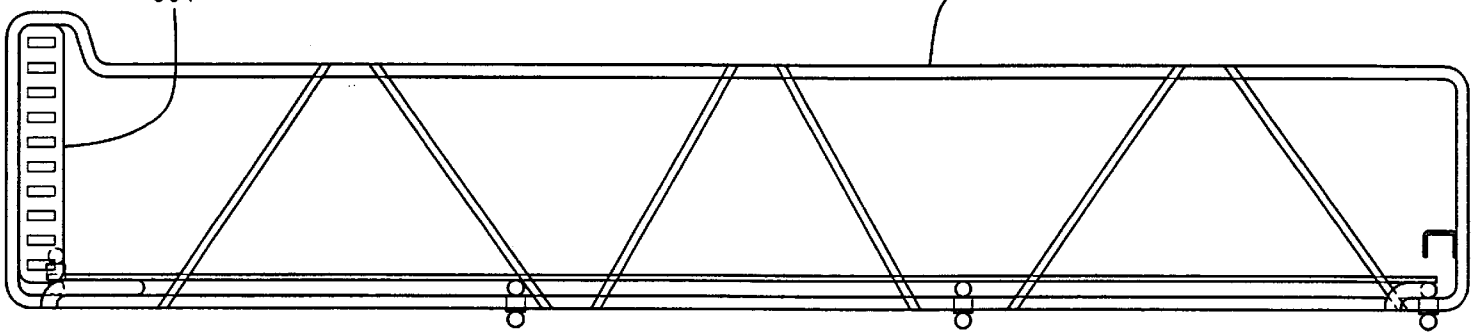
FIG. 24 is a side elevation and detailed view of a portion of the front of a shelf such as those shown in FIG. 1.
Figure 27:
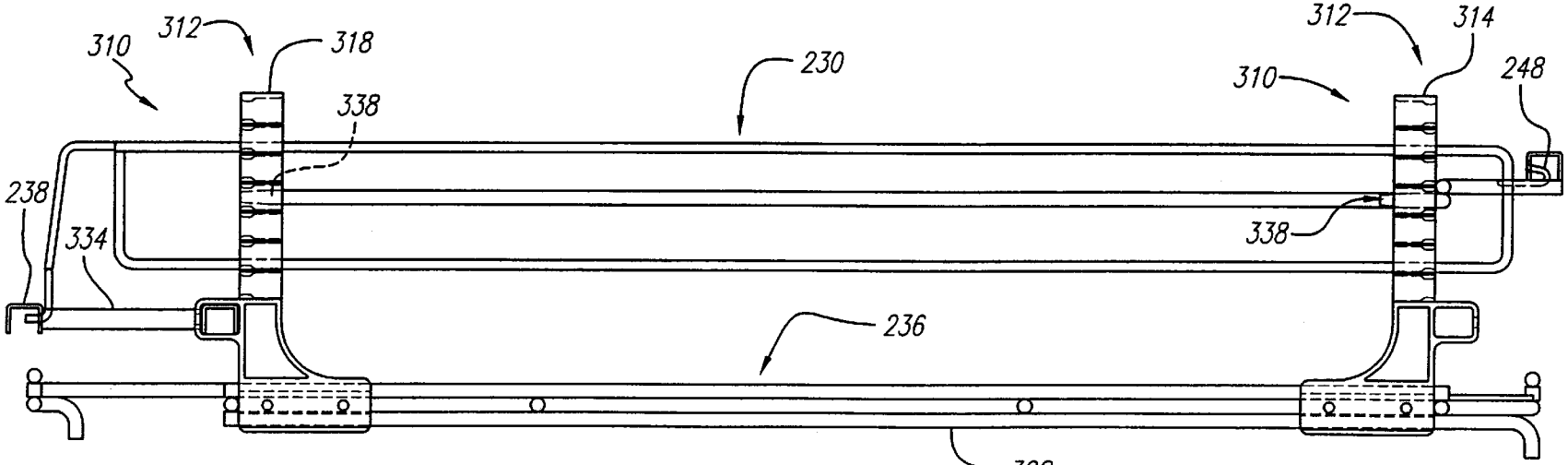
FIG. 27 is a side elevation view of the shelf assembly of FIG. 26.

In an alternative form of a shelf assembly, a shelf assembly 284 (FIGS. 23, 24) includes a conventional wire shelf assembly 286 with wires 288, cross bars 290 and hooks 292 and 294 for engaging a conventional shelf post arrangement. The shelf preferably includes a right product stop 296, a left product stop 298 and a rear product stop bar 300 having apertures 302 for engaging rear hooks on a divider, such as that shown in FIGS. 15–21. The shelf also preferably includes front product stop adjuster brackets or plates 304 arranged and configured in a manner similar to those described above with respect to FIGS. 6–8 and 13. A combined front product stop bar and divider support is positioned and supported by the brackets 304 in a manner similar to that described above with respect to FIGS. 6–8, 13 and 18. This shelf assembly can be used in conventional shelving systems using conventional shelf posts.

In an alternative embodiment of several aspects of the inventions (FIGS. 26–45) a shelving assembly 306 includes a conventional wire shelf 308 and a combination product stop and divider assembly 310 which can be retrofit onto conventional wire shelves. The assembly 310 includes one or more product stop brackets 312, including a left front bracket 314, a right front bracket 316, a left rear bracket 318 and a right rear bracket 320, for supporting the front and rear product stops and for supporting any dividers which may be used on the shelf assembly. Each bracket 312 permits the level of the front and rear product stops to be adjusted, and also permits the level of the left and right side product stops to be adjusted. Each bracket 312 preferably includes a groove 322 extending longitudinally through a base 324 of the bracket for receiving to side rails from the shelf so that the bracket can be mounted on the shelf The base 324 of the bracket is placed over the upper reinforcing wire 326 and a lower reinforcing wire 328 on the shelf and preferably locked in placed through push rivets (not shown) passing through holes 330 through the base.

The stop brackets 312 also preferably include a mounting element such as an enclosed wall 332 for receiving and holding end and of a rear product stop 334. A number of slots, grooves, openings or other support surfaces 336 are formed vertically aligned above the base 324 to receive, support and hold a respective engagement extension 338 on the combination product stop and divider assembly 310. The openings 336 preferably extend entirely through the bracket 312 to accommodate tolerances in the assembly. The openings 336 are dimensioned so as to receive and reliably support the engagement extensions 338, given the size and configuration of those extensions. The openings are preferably aligned exactly vertically to give the desired amount of adjustability in the product stop and divider assembly. The openings may be formed straight through the bracket, or may include one or more counter bores to make insertion of the extensions easier.

In the combination product stop and divider assembly 310 includes a front and side frame 340. The frame 340 includes a front product stop and aperture bar 342 having a function and structure similar to that described above. The bar 342 is supported by and fixed to a left angled frame talent 344 and a right angle frame element 346 which extends rearwardly and outwardly to a left front engagement extension 348 and a right front engagement extension 350 for engaging the respective brackets 314 and 316. The frame 340 also includes a left product stop 352 and a right product stop 354 extending rearwardly to a left rear engagement extension 356 and a right rear engagement extension 358, respectively. The engagement extensions 356 and 358 extend into and are supported by respective brackets 318 and 320. As is apparent, the frame 340 can be adjusted vertically upward or downward in the brackets 312.

The combination product stop and divider assembly 310 also preferably includes the back stop 334 having a rear product stop bar 360 held in the brackets 312 and supported by the brackets through a left mounting element 362 and a right mounting element 364 having longitudinally or rearwardly extending flange is 366 and 368. The rear product stop bar 360 preferably as the same structure and function as the rear product stop bar previously described.

The dividers 230 are then installed in the combination product stop and divider assembly 310 in a manner similar to that described above with respect to FIG. 18. The dividers are preferably used in the assembly so that the tension developed between the hooks 248 and 238 hold the frame 340 in the brackets 312. Alternatively, different dividers can be used, or dividers can be omitted entirely, and the frame 340 held in place by suitable pins, latches, blocks or the like.

In further alternative embodiments, other front stop bars 370, 372 and 374 may be mounted to the front reinforcing wires of a wire shelf through a mounting bracket 376 having a sleeve or channel 378 for receiving a respective free end of the front stop bar 370, 372 or 374. The mounting bracket includes a U-shaped bracket 380 for engaging preferably 2 of the front reinforcing wires on the wire shelf. The bracket 376 is locked on the shelf when the respective free end of the front stop bar passes through the sleeve 378 and closes the gap across the U-shaped bracket 380. With two mounting brackets at each end of the front of the shelf, the front stop bars are held in place.

An alternative front stop bar 382 includes a stop bar 384 and an attached U-shaped mounting bracket 386 which is set over preferably two reinforcing wires to hold the stop bar and place. When the mounting bracket 386 is placed over the wires, a slide lock 388 is passed through respective openings 390 to lock the stop bar in place.

Each of the stop bars can also include apertures or other engagement surfaces for receiving and holding dividers. The stop bars can also be used at other locations on the shelf, such as the sides and the rear portion of the shelf Such a rear product stop bar can also include engagement surfaces for receiving and supporting dividers in a manner described above.

Figure 46:
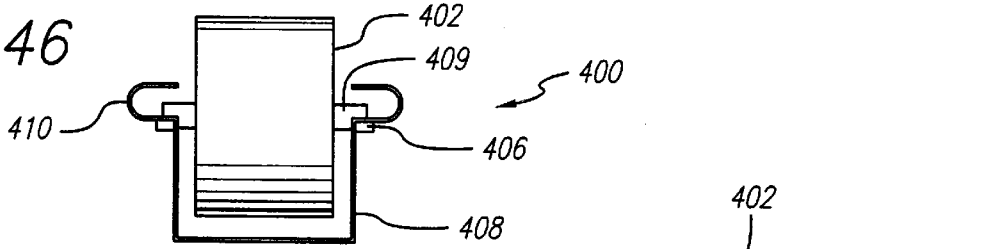
FIG. 46 is an end view of a roller cartridge for use in a flat or gravity feed shelf system using wire or other shelves having openings large enough to accommodate one or more rollers.
Figure 47:
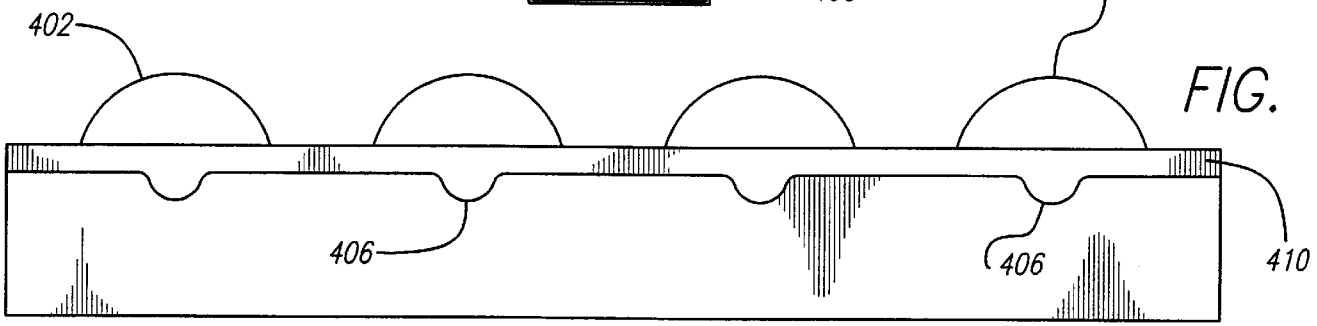
FIG. 47 is a side elevation view of the roller cartridge of FIG. 46.
Figure 48:
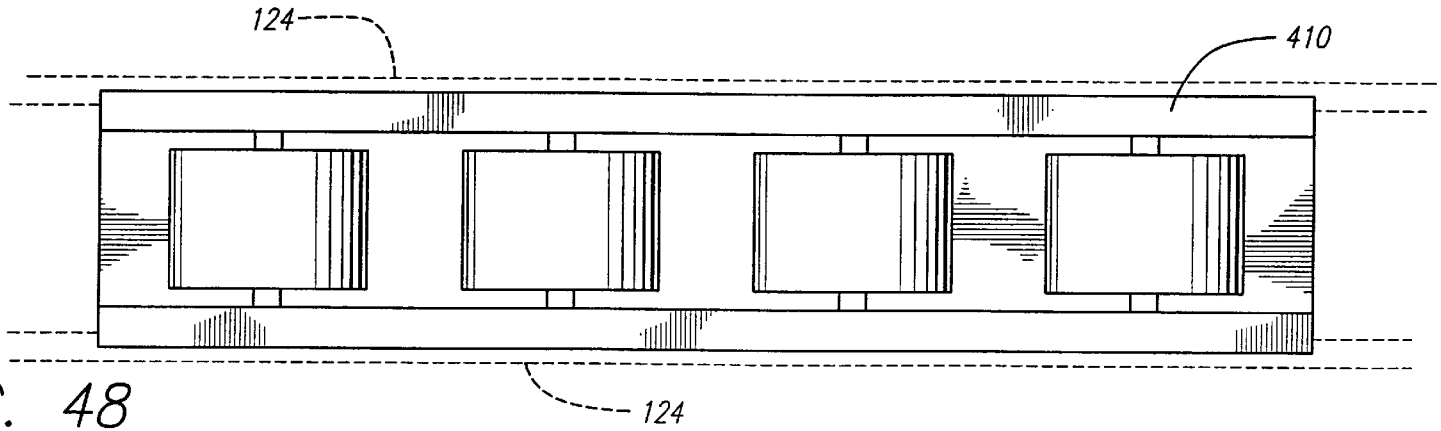
FIG. 48 is a top plan view of the roller cartridge of FIG. 46 showing one application in a wire shelf

As an alternative to a glide sheet, such as for large packages and corrugated boxes or containers, roller packs 400 (FIGS. 46–48) may be inserted between wires 124 on a wire shelf, and between reinforcing bars 134, to make easier moving of the packages or containers toward the front of the shelf The roller packs 400 can be sized and configured to fit between any shape and size of wire shelf wires 124, and can be used with was all shelves or angled shelves. In one embodiment, one or more rollers 402, which may be made from a suitable plastic, may include axle's 404 captured in channels 406 for allowing rotation of the rollers 402, while holding the rollers longitudinally stationary. The rollers are assembled in a carriage box 408 for convenient storage and for placement between individual wires 124 in a shelf. The carriage box 408 includes shoulders 410 for covering the axle's 404 and for resting on the wires 124 of the shelf.

Although the present inventions have been described in terms of the preferred embodiments above, the described embodiments of the invention are only considered to be preferred and illustrative of the inventive concept; the scope of the invention is not to be limited or restricted to such embodiments. Various and other numerous arrangements and modifications may be devised without departing from the spirit and scope of the inventions. Accordingly, the present invention is not limited to those embodiments precisely shown and described in the specification. It is intended that the scope of the present inventions extends to all such modifications and/or additions and that the scope of the present inventions is limited solely by the claims set forth below.

What is claimed is:

1. A shelving system comprising:

an integral shelf having a front and a first side and a second side;

a shelf support structure including a plurality of shelf posts and a bracket having a plurality of shelf assembly support surfaces for supporting a shelf assembly, the shelf assembly support surfaces being spaced-apart from each other in a direction other than exactly vertically and wherein each of the shelf assembly support surfaces includes a first segment that extends in a first direction at least partially vertically and a second segment extending from the first segment in a direction that is different from the first direction, at least partially horizontal and at least partially towards the shelf front; and a shelf support element engaging the shelf at at least one of the front, or first or second sides, the shelf support element also engaging at least one of the plurality shelf assembly support surfaces in the shelf support structure.

2. The shelving system of claim 1 wherein at least one of the shelf posts includes one or more vertically spaced apart openings for engaging and supporting the bracket, and wherein the shelf support element engages at least one of the support surfaces on the bracket.

3. The shelving system of claim 2 wherein the shelf support element engages the bracket and wherein the bracket is supported by a first shelf post through at least one of the vertically spaced apart openings and engages a second shelf post having a plurality of vertically spaced apart openings through at least one of the vertically spaced apart openings.

4. The shelving system of claim 1 wherein the shelf support element engages the shelf at at least one side thereof, and wherein the shelf support element engages a plurality of the shelf assembly support surfaces on the shelf support structure.

5. The shelving system of claim 1 wherein the shelf posts each have a plurality of openings for supporting the bracket, wherein the bracket extends between first and second shelf posts in the plurality of shelf posts, and wherein the shelf assembly support surfaces include a plurality of slots defining at least part of an angle for receiving the shelf support element.

6. The shelving system of claim 2 wherein the bracket is adjustable upward and downward on the plurality of shelf posts.

7. The shelving system of claim 6 wherein the bracket extends substantially horizontally between spaced apart shelf posts and includes an upper surface into which are formed the plurality of shelf assembly support surfaces and wherein each of the first segments of the plurality of shelf assembly support surfaces extend substantially downwardly from the upper surface and wherein each of the second segments extends substantially forwardly.

8. The shelving system of claim 7 wherein the bracket is a first bracket having a first side and further comprising a second bracket having a first side parallel to the first side of the first bracket and wherein the shelf includes a first bar extending at least partially horizontally from the first side of the shelf and a second bar extending at least partially horizontally from a second side of the shelf for engaging respective support surfaces in respective brackets.

9. The shelving system of claim 8 wherein the second segment extends downwardly and forwardly from the first segment.

10. The shelving system of claim 9 herein the first segment is shorter than the second segment.

11. A shelf support system comprising:

at least front and rear structural support elements spaced apart from each other;

a shelf support bracket extending longitudinally from the front structural support element toward the rear structural support element; and wherein the shelf support bracket includes a plurality of walls defining respective slots for receiving a shelf support element, wherein the slots are formed in an upper surface of the shelf support bracket and extend at least partly downwardly and wherein the slots have first and second segments, the first segment extending substantially downwardly and the second segment extending from the first segment substantially in a direction toward the front structural support element and wherein at least first and second ones of the slots have first segments that are different lengths.

12. The shelf support system of claim 11 wherein the front and rear structural support elements are shelf posts having walls defining a plurality of openings for receiving and supporting engagement elements on the shelf support bracket.

13. The shelf support system of claim 12, wherein each shelf post includes two vertically arranged columns of openings.

14. The shelf support system of claim 12 wherein each of the plurality of openings have an oval shape.

15. The shelf support system of claim 11 wherein the shelf support bracket extends between and is supported by the front and rear structural support elements, wherein the front and rear structural support elements include respective walls defining openings for receiving the shelf support bracket and wherein the openings in the front structural support element face the openings in the rear structural support element.

16. The shelf support system of claim 11 wherein each of the slots have an identical shape.

17. The shelf support system of claim 11 wherein the slots are spaced apart from each other in a longitudinal direction.

18. The shelf support system of claim 11 wherein the slots are substantially T-shaped.

19. The shelf support system of claim 18 wherein at least one of the T-shaped slots is substantially asymmetrical.

20. The shelf support system of claim 11 further comprising an engagement member for reducing the probability of the bracket being moved from the shelf post.

21. A shelf support system, comprising:

at least first and second substantial upright structural support elements spaced apart from one another; and a shelf support bracket extending longitudinally from the first structural support element toward the second structural support element and including an upper surface and a plurality of shelf support element slots in the upper surface, the shelf support element slots including a first segment including a top end and a bottom end and a second segment extending from the bottom end of the first segment and extending at an angle from a horizontal axis other than 90 degrees.

22. The shelf support system of claim 21 wherein the first segments of the shelf support element slots extend vertically.

23. The shelf support system of claim 21 wherein the shelf support element slots are longitudinally spaced.

24. The shelf support system of claim 21 wherein the shelf support element slots are substantially identical.

25. The shelf support system of claim 21 wherein the second segments have their vertical component and horizontal component combining to extend downwardly in a direction toward the first structural support element.

26. The shelf support system of claim 25 wherein the second segments extend farther in the direction toward the first structural support element than they extend downwardly.

27. The shelf support system of claim 25 further comprising a second shelf support bracket extending longitudinally from the first structural support element toward the second structural support element and including shelf support element slots having a component extending downwardly in a direction toward the first structural support element.

28. The shelf support system of claim 21 wherein the second segment is longer than the first segment.

29. The shelf support system of claim 21 wherein the second segment extends only toward the first structural support element from the first segment.

30. The shelf support system of claim 21 wherein the second segment includes a rounded end portion.

31. The shelf support system of claim 21 wherein the shelf support bracket is removable from the first structural support element.

32. The shelf support system of claim 31 wherein the shelf support bracket includes a hook for engaging the first structural support element.

33. The shelf support system of claim 22 wherein the shelf support bracket includes vertically spaced hooks for engaging the first structural support element.

34. The shelf support system of claim 21 wherein the shelf support bracket includes a fastener for removably engaging the first structural support element.

35. The shelf support system of claim 21 wherein the shelf support bracket includes a hook for engaging the second structural support element.

36. The shelf support system of claim 35 wherein the shelf support bracket includes a projection spaced apart from the hook for standing into an opening in the second structural support element.

37. A shelf support system, comprising:

at least first and second structural support elements spaced apart from one another; and a shelf support bracket extending longitudinally from the first structural support element toward the second structural support element and including an upper surface and a plurality of substantially T-shaped shelf support element slots in the upper surface wherein at least two of the T-shaped shelf support elements are sized differently from each other.

38. The shelf support system of claim 37 wherein the T-shaped shelf support element slots include a substantially vertical portion and a substantially horizontal portion.

39. The shelf support system of claim 38 wherein the horizontal portions of at least two of the T-shaped shelf support element slots are positioned different horizontal distances from the upper surface of the shelf support bracket.

40. The shelf support system of claim 38 wherein the horizontal portions of adjacent T-shaped shelf support element slots are positioned different horizontal distances from the upper surface of the shelf support bracket.

41. A shelf support system comprising:

at least first and second structural support elements spaced apart from each other;

a shelf support bracket extending longitudinally from the first structural support element toward the second structural support element; and wherein the shelf support bracket includes a plurality of walls defining respective slots for receiving a shelf support element, wherein the slots are formed in an upper surface of the shelf support bracket and extend at least partly downwardly, wherein the shelf support bracket extends between and is supported by the first and second structural support elements, wherein the first and second structural support elements include respective walls defining openings for receiving the shelf support bracket and wherein the openings in the first structural support element face the openings in the second structural support element, wherein the slots have a shape having first and second segments, the first segment extending substantially downwardly, and the second segment extending in a direction toward the first structural support element wherein the slots are substantially T-shaped, and wherein the T-shaped slots are distributed in at least two groups, the first group being closer to a top of the shelf support bracket.

* * * * *

UNITED STATES PATENT AND TRADEMARK OFFICE

CERTIFICATE OF CORRECTION

PATENT NO. : 6,302,036 B1
DATED : October 16, 2001
INVENTOR(S) : Tim Carson and V. John Ondrasik et al.

It is certified that error appears in the above-identified patent and that said Letters Patent is hereby corrected as shown below:

Column 21,
Line 4, change "herein" to -- wherein --.

Column 22,
Line 31, change "22" to -- 32 --.

Signed and Sealed this

Fourteenth Day of May, 2002

*Attest:*

*Attesting Officer*

JAMES E. ROGAN
*Director of the United States Patent and Trademark Office*